US006779567B1

(12) United States Patent
Szatmary

(10) Patent No.: US 6,779,567 B1
(45) Date of Patent: Aug. 24, 2004

(54) RAPID TRANSFER PORT

(75) Inventor: Michael A. Szatmary, Ft. Worth, TX (US)

(73) Assignee: La Calhene, Inc., Rush City, MN (US)

( * ) Notice: Subject to any disclaimer, the term of this patent is extended or adjusted under 35 U.S.C. 154(b) by 0 days.

(21) Appl. No.: 09/743,390

(22) PCT Filed: Jul. 9, 1999

(86) PCT No.: PCT/US99/15582

§ 371 (c)(1),
(2), (4) Date: Mar. 18, 2002

(87) PCT Pub. No.: WO00/02659

PCT Pub. Date: Jan. 20, 2000

(Under 37 CFR 1.47)

Related U.S. Application Data

(60) Provisional application No. 60/092,299, filed on Jul. 10, 1998.

(51) Int. Cl.[7] ..... B65B 31/00

(52) U.S. Cl. ..... 141/51; 141/85; 141/98; 141/287; 141/346; 141/348; 49/477.1; 414/292

(58) Field of Search ..... 141/46, 51, 85, 141/98, 231, 286, 287, 346, 348, 363; 49/62, 477.1; 220/259.1; 292/256.65; 414/217, 292

(56) References Cited

U.S. PATENT DOCUMENTS

| | | | | | |
|---|---|---|---|---|---|
| 4,073,521 | A | * | 2/1978 | Mena | 292/256.65 |
| 4,260,312 | A | * | 4/1981 | Hackney | 414/292 |
| 5,226,781 | A | * | 7/1993 | Glachet et al. | 414/217 |
| 5,291,923 | A | * | 3/1994 | Gallagher et al. | 141/98 |
| 5,425,400 | A | * | 6/1995 | Szatmary | 141/98 |

* cited by examiner

*Primary Examiner*—Gregory L. Huson
*Assistant Examiner*—Peter deVore
(74) *Attorney, Agent, or Firm*—Barnes & Thornburg

(57) ABSTRACT

A transfer port apparatus (10) is provided to enable a worker to transfer one or more objects through a sealed passageway provided in the apparatus (10) from one sealed chamber into another sealed chamber. Transfer port apparatus (10) is adapted to be coupled to a movable canister (12) and a stationary isolator (16). Expandable airtight seals (72, 120) are deflated, doors (30, 40) are removed and an object (20) is transferred into the airtight clean working environment established in the isolator (16) through the sealed passageway established in transfer port apparatus (10) following coupling of canister (12) to isolator (16) using transfer port apparatus (10). After the object (20) is moved, doors (30, 40) are replaced and expandable airtight seals (72, 120) are inflated creating a substantially airtight seal. Movable canister (12) can be uncoupled from the transfer port apparatus (10).

50 Claims, 30 Drawing Sheets

Notes: 1. Capacitors C1,C2,C3,C4,C8,C9,C13,C14,C15 are polarized

RAPID TRANSFER PORT

This application claims benefit of provisional application No. 60/092,299 filed Jul. 10, 1998.

BACKGROUND AND SUMMARY OF THE INVENTION

The present invention relates to a transfer port apparatus and method of transferring objects through a transfer conduit from a canister into an isolation chamber. In particular, the present invention relates to an apparatus and method for establishing airtight sealed connections in a transfer conduit provided in a transfer port apparatus.

In industries which require working in a space, isolated from the external atmosphere, i.e., a sealed confinement enclosure, it is customary to operate the input and the output of the different products and apparatus by means of containers connected to the enclosure with a double-door, sealed transfer device. The industries concerned with this technology are, in particular, the pharmaceutical, medical, foodstuffs and nuclear industries etc.

It is known to provide isolation chambers or "clean rooms" to provide an aseptic or sterile environment for various purposes. In clean rooms, elaborate precautions are taken to reduce dust particles and other contaminants in the air. The pharmaceutical industry uses the sterile environment provided by the isolating chambers for conducting experiments and tests and for manufacturing drugs. The electronics industry uses clean rooms to manufacture various type of electrical components. Because the clean room must be kept aseptic or sterile in order for the experiments and the testing or manufacturing procedures to be effective, it is desirable to reduce the likelihood that contaminants will be transferred into the isolation chamber. Therefore, problems arise when items must be transferred from a non-sterile environment outside the isolation chamber into the isolation chamber.

A transfer port apparatus and method is disclosed in U.S. Pat. No. 5,425,400 to Szatmary, which disclosure is hereby incorporated by reference herein. See also the disclosure in U.S. Pat. Nos. 4,494,586; 4,747,601; 5,263,521; 5,588,473; 5,700,043; 5,226,781; and 4,897,963, which disclosures are also hereby incorporated by reference herein.

In accordance with the present invention, a transfer port apparatus is provided to enable material to be transferred from an isolation chamber in an isolator to a canister chamber in a mobile canister. The transfer port apparatus includes a canister portion formed to include a canister passageway and adapted to be coupled to the canister to place the canister passageway in communication with the canister chamber formed in the canister, and an isolator portion formed to include an isolator passageway and adapted to be coupled to the isolator to place the isolator passageway in communication with the isolation chamber formed in the isolator.

A latch is arranged to couple the canister portion to the isolator portion to place the canister passageway in communication with the isolator passageway to establish a transfer conduit through the canister and isolator portions to enable material to be transferred between the canister chamber and the isolation chamber through the transfer conduit. A removable conduit closure is arranged to lie in and occlude the transfer conduit. The canister portion includes a seal support and an expansible seal member mounted on the seal support and arranged to move relative to the seal support from a contracted position to an expanded position to establish a substantially airtight sealing engagement with the removable conduit closure.

In preferred embodiments, wherein the expansible seal member includes an inner ring configured to mate with and seal against the removable conduit closure upon insertion of the removable conduit closure into the canister passageway formed in the canister portion. The transfer port apparatus further includes a pneumatic system for passing a pressurized fluid through an air conduit formed in the seal support to a fluid-receiving space provided between the seal support and the inner ring to move the inner ring away from the seal support to the expanded position against the removable conduit closure.

The removable conduit closure includes a canister door sized to close the canister passageway and the inner ring is positioned to engage an outer surface of the canister door upon movement of the expansible seal member to the expanded position to establish a substantially airtight seal therebetween. The removable conduit closure further includes an isolator door sized to close the isolator passageway and arranged to lie adjacent to the canister door when the canister portion is coupled to the isolator portion.

The transfer port apparatus further includes a valve and conduit system for retaining the pressurized fluid in the fluid-receiving space to maintain the inner ring in the expanded position engaging the outer surface of the canister door upon decoupling of the canister portion and isolator portion while the canister door is positioned to close the canister passageway and the isolator door is positioned to close the isolator passageway. A valve is coupled to the air conduit formed in the seal support and configured to move between an opened position allowing flow of pressurized fluid into the air conduit to reach the inner ring and a closed position retaining pressurized fluid in the air conduit to maintain the inner ring in the expanded position. This system enables a user to inflate the canister seal and retain that seal in an inflated state even though the canister is uncoupled from the isolator and the pressurized fluid onboard the isolator is no longer communicated to the canister seal.

A vacuum system is provided for removing the pressurized fluid from the fluid-receiving space and applying a suction force to the inner ring in the fluid-receiving space to move the inner ring from the expanded position to the contracted position to disestablish the substantially airtight sealing engagement with the removable conduit closure. The vacuum system includes a vacuum generator and a pressure selector coupled to the vacuum generator, the pressurized fluid source, and the air conduit and configured to move between a seal-establishing position coupling only the pressurized fluid source to the air conduit and a seal-disestablishing position coupling only the vacuum generator to the air conduit.

A distribution conduit is coupled to the pressurized fluid source and a connector coupled to the distribution conduit and configured to be coupled to the air conduit upon coupling of the canister portion to the isolator portion to enable pressurized fluid to pass from the pressurized fluid source into the air conduit through the distribution conduit and the connector. The isolator portion is formed to include a portion of the distribution conduit therein.

Additional features and advantage of the invention will become apparent to those skilled in the art upon consideration of the following detailed description of prepared embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 10:
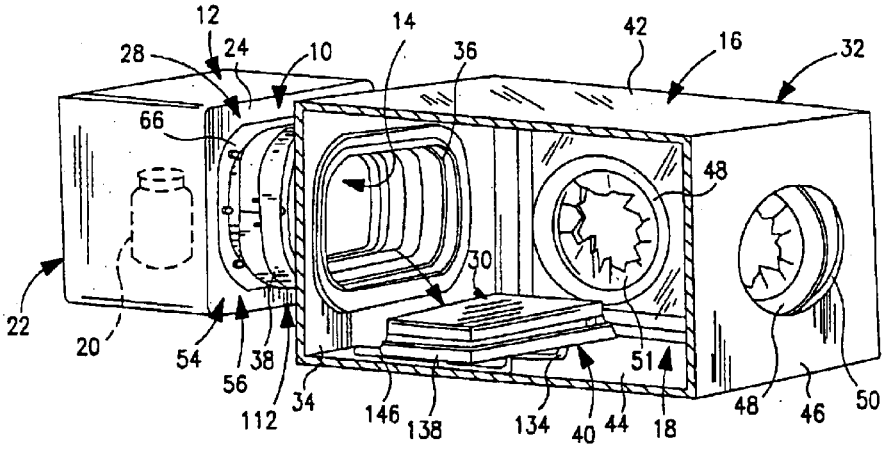
FIG. 10 is a perspective view similar to FIGS. 4, 6, and 8 showing the canister door after it has been moved to an opened position to open a passageway formed in the canister portion of the transfer port apparatus and placed above the isolator door in a "nested" position in a cavity formed in the isolator door.
Figure 11:
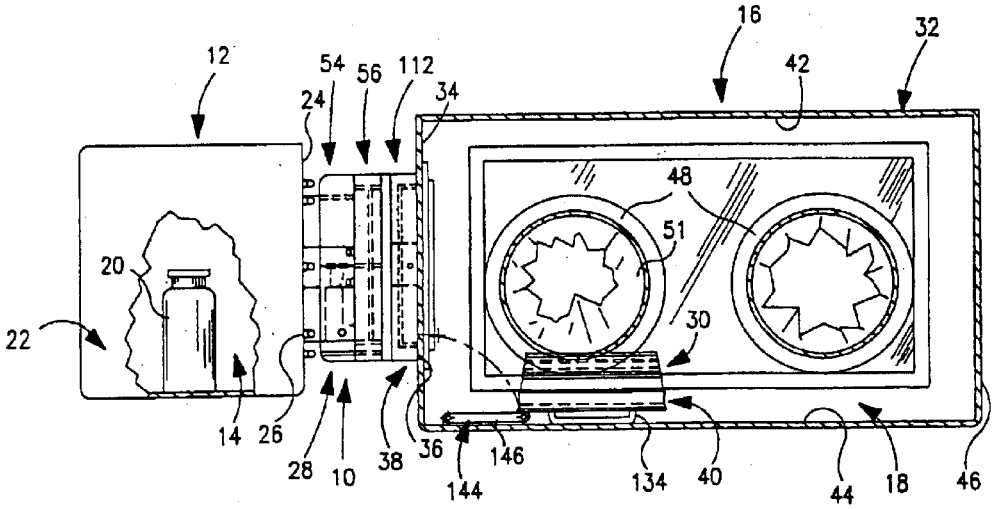
FIG. 11 is a side elevation view of the apparatus shown in FIG. 10.
Figure 12:
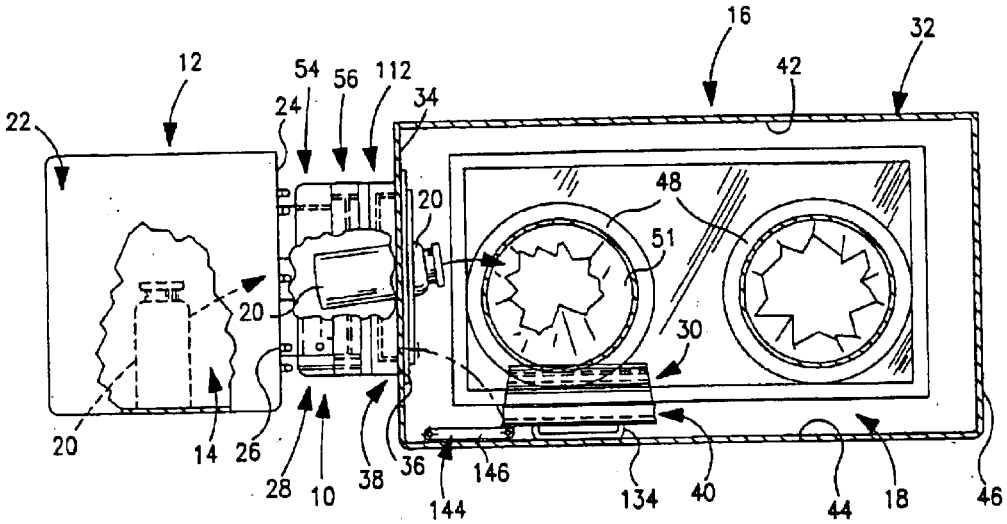
FIG. 12 is a side elevation view similar to FIG. 11, with portions broken away, showing movement of the bottle in the canister chamber into the isolation chamber through the sealed transfer conduit passageway formed in the transfer port apparatus and opened upon removal of the canister door and isolator door from passageway-closing positions in the canister portion and the isolator portion.
Figure 13:
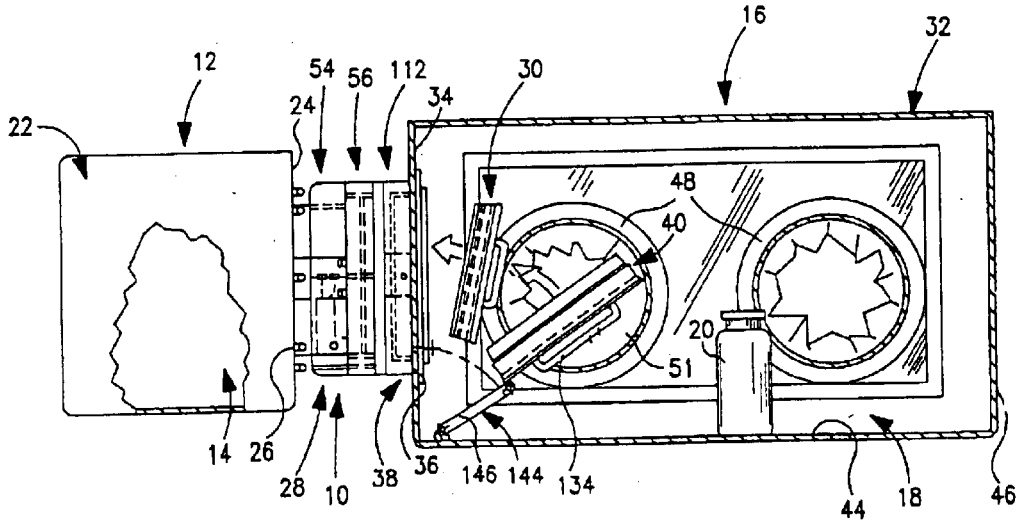
FIG. 13 is a view similar to FIG. 12 showing movement of the canister door and the isolator door toward their passageway-closing positions after transfer of the bottle into the isolation chamber.

A transfer port apparatus 10 is provided to enable a worker to transfer one or more objects through a sealed passageway or transfer conduit provided in the apparatus 10 from one sealed chamber into another sealed chamber without contaminating clean working environments established in the two sealed chambers as shown, for example, in FIGS. 4–14. Transfer port apparatus 10 includes several components as shown in FIGS. 1–3A and, as shown in FIGS. 1 and 3A–5, is adapted to be coupled to a movable canister 12 formed to include a canister chamber 14 and a stationary isolator 16 formed to include an isolation chamber 18. In most cases, isolator 16 will be stationary but it could also be movable. In the illustrated embodiment, an object 20 is placed in the airtight clean working environment established in canister chamber 14 and later transferred into the airtight clean working environment established in isolation chamber 18 through a sealed transfer conduit or passageway established in transfer port apparatus 10 following coupling of canister 12 to isolator 16 using transfer port apparatus 10 as shown in FIGS. 12 and 13.

Figure 1:
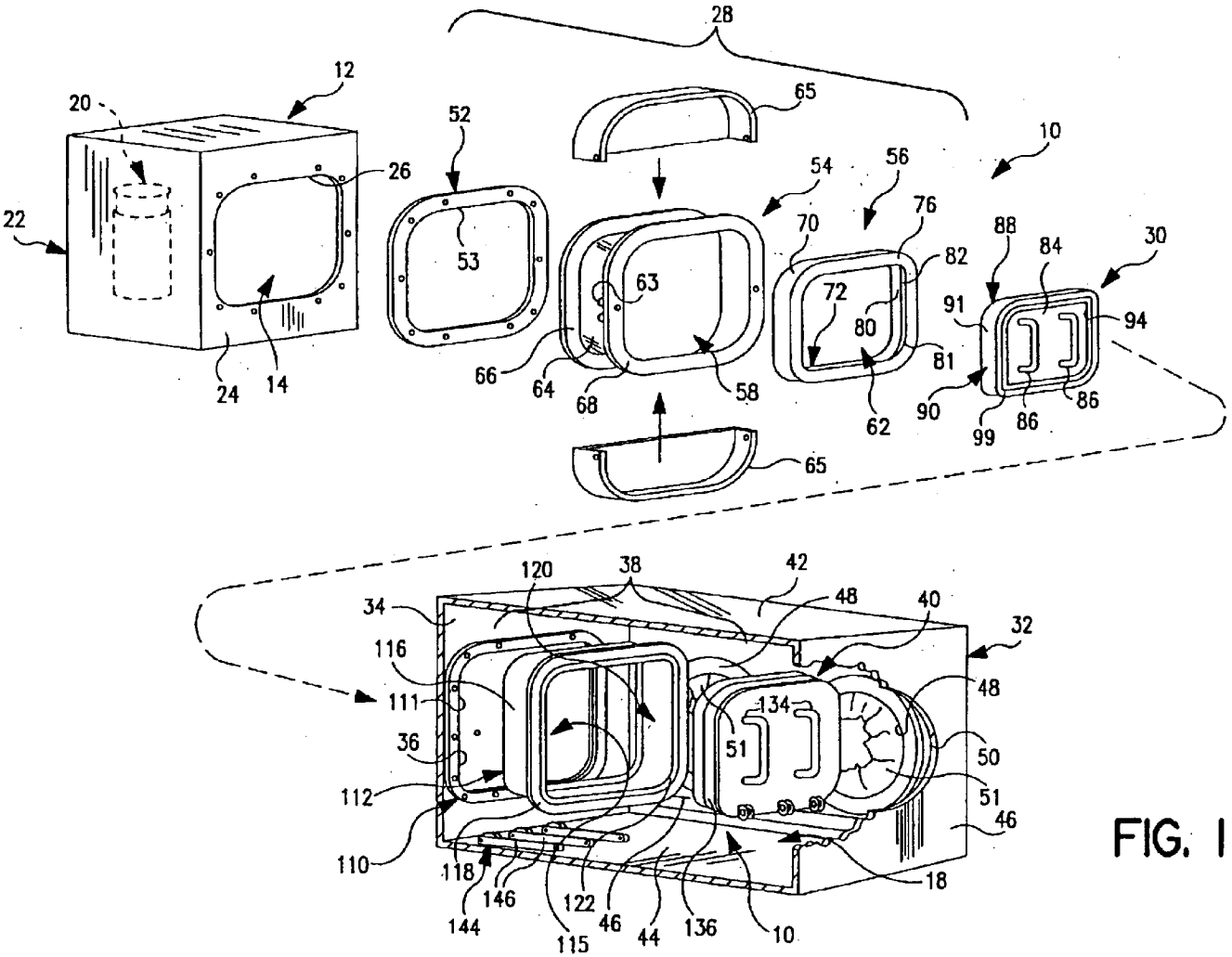
FIG. 1 is an exploded perspective view of a transfer port apparatus in accordance with the present invention showing a canister formed to include a canister chamber containing a bottle (in phantom), an isolator formed to include an isolation chamber accessible to a worker by means of two access ports, several components just outside the canister chamber that cooperate to form a canister portion of the transfer port apparatus, and several components in the isolation chamber that cooperate to form an isolator portion of the transfer port apparatus.
Figure 2:
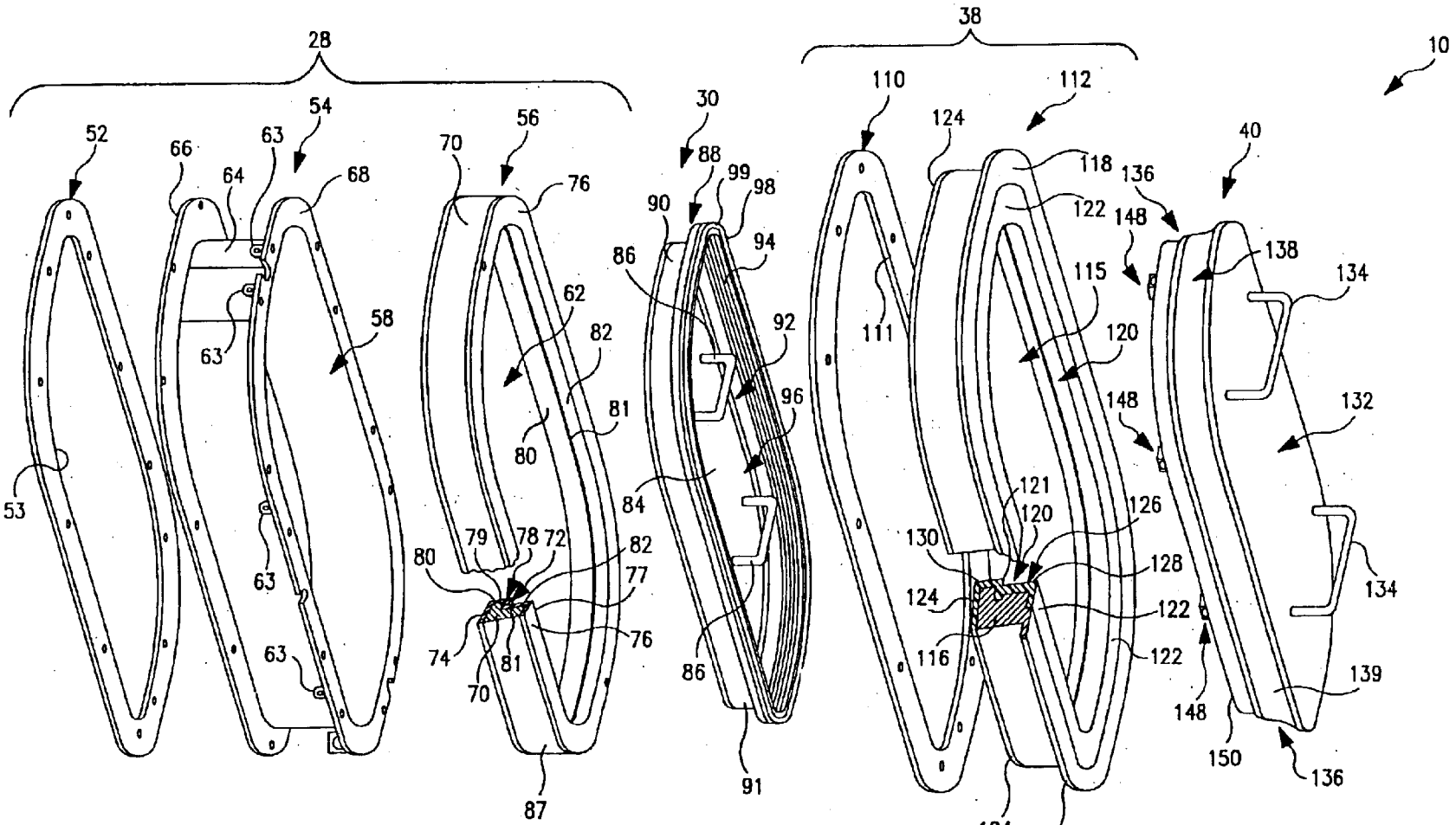
FIG. 2 is an exploded, perspective, assembly view of components comprising the transfer port apparatus of FIG. 1 showing (from left to right) a canister gasket, mounting fixture, canister door frame including an inflatable seal member carried on a sturdy ring-shaped seal support, canister door, isolator gasket, isolator door frame including an inflatable seal member carried on a sturdy ring-shaped seal support, and isolator door.

Canister 12 includes a shell 22 and a canister wall 24 coupled to shell 22 to define canister chamber 14 as shown in FIG. 1. Canister wall 24 is formed to include an opening 26 arranged to communicate with the transfer conduit formed in transfer port apparatus 10. In the illustrated embodiment, transfer port apparatus 10 includes a canister portion 28 coupled to canister wall 24 at opening 26 and a removable canister door 30 normally closing a passageway established in canister portion 28 and arranged to communicate with canister chamber 14 via opening 26 as shown, for example, in FIGS. 3A–5. Canister door 30 is made of aluminum.

Isolator 16 includes a shell 32 and an isolator wall 34 coupled to shell 32 to define isolation chamber 18 as shown in FIG. 1. Isolator wall 34 is formed to include an opening 36 arranged to communicate with the transfer conduit or passageway formed in transfer port apparatus 10. In the illustrated embodiment, transfer port apparatus 10 further includes an isolator portion 38 coupled to isolator wall 34 at opening 36 and a removable isolator door 40 normally closing a passageway established in isolator portion 38 and arranged to communicate with isolation chamber 18 via opening 36 as shown, for example, in FIGS. 3A–5. Isolator door 40 is made of aluminum. Canister door 30 and isolator door 40 cooperate to define a conduit closure that can be inserted into the transfer conduit formed in transfer apparatus 10 to occlude the transfer conduit as shown, for example, in FIGS. 6 and 7 and that can be removed from the transfer conduit as shown, for example, in FIGS. 10–12.

Isolator shell 32 includes a top wall 42, a bottom wall 44, and side walls 46 coupled to walls 42 and 44. One side wall 46 is formed to include a pair of access ports or arm holes 48 and another side wall 46 is formed to include an observation window 50. Access devices 51 such as rubber gloves (not shown) and glove rings are attached to side wall 46 at access ports 48 in an air-tight manner and arranged to extend into isolation chamber 18 to enable a worker (not shown) alongside isolator 16 to handle object 20 or other material inside isolation chamber 18 without communicating air from the surroundings into isolation chamber 18 (and vice versa). Although isolator 16 is shown as having a rectangular shape and one of the long side walls 46 is shown to have two access ports 48, it is within the scope of the invention as presently perceived for isolator 16 to have some other shape, be defined by more or fewer side walls 46, and be provided with other types or numbers of access devices and/or observation windows.

Canister portion 28 of transfer port apparatus 10 includes a gasket 52 formed to include a central opening 53 and made of a suitable sealing material, an optional mounting fixture 54 formed to include a central opening 58 and adapted to be coupled to canister wall 24 at opening 26, and a canister door frame 56 coupled to mounting fixture 54. Canister door 30 is configured and sized to open and close a central opening 62 formed in canister door frame 56. Once canister portion 28 of transfer port apparatus 10 is assembled and coupled to canister 12 at opening 26 in canister wall 24, central openings 53, 58, and 62 cooperate to define a canister passageway having an outlet communicating with canister chamber 14 via opening 26 in canister wall 24 and an inlet that is closable by engagement of canister door 30 and canister door frame 56 and openable by disengagement of canister door 30 and canister door frame 56. In one embodiment, each of gasket 52, mounting fixture 54, canister door frame 56, and canister door 30 have a somewhat rectangular or oblong ring shape.

Mounting fixture 54 includes a somewhat square-shaped body 64, a first flange 66 appended to one edge of body 64 and adapted to abut gasket 52 and be coupled to canister wall 24 by connectors 67, and a second flange 68 appended to an opposite edge of body 64 and adapted to abut canister door frame 56 as shown in FIG. 3. Mounting fixture 54 further includes an annular shroud 65 surrounding body 64 and coupled to tabs 63 appended to second flange 68 by connectors 61.

Canister door frame 56 includes a seal support ring 70 and a seal member 72 carried on seal support ring 70. Seal member 72 is configured to establish substantially airtight sealing engagement with mounting fixture 54, with canister door 30 when canister door 30 is mounted to close central opening 62 in canister door frame 56, and with isolator portion 38 of transfer port apparatus 10 when canister portion 28 is mated with isolator portion 38. Support ring 70 is made of aluminum and seal member 72 is made of a flexible, expansible, plastic material such as HYPALON material.

Seal member 72 includes a back ring 74, a front ring 76 positioned to lie in axially spaced-apart parallel relation to back ring 74, and an inner ring 78 interconnecting inner edges of back and front rings 74, 76. Inner ring 78 is configured to mate with and seal against canister door 30 upon insertion of canister door 30 into central aperture 58 formed in canister door frame 56. In the illustrated embodiment, inner ring 78 includes a first frustoconical section providing surface 80, a second frustoconical section providing surface 82, and an annular ledge 81 positioned to lie between and interconnect surfaces 80 and 82.

Likewise, seal support ring 70 includes a back rim surface 75, a front rim surface 77 positioned to lie in axially spaced-apart parallel relation to back rim surface 75, an inner ring surface 79 interconnecting inner edges of back and front rim surfaces 75, 77, and an outer ring surface 87 spaced apart from inner ring surface 79 . In the illustrated embodiment, inner ring surface 79 includes a first portion 73, a second portion 83, and an annular groove portion 85 positioned to lie between and interconnect portions 73, 83.

Inner ring 78 of seal member 72 completely covers inner ring surface 79 of seal support ring 70 to form a one-piece covering over inner ring surface 79. Because inner ring 78 provides a one-piece covering, seal member 72 is easy to clean because there are not multiple pieces of material to clean.

Figure 15:
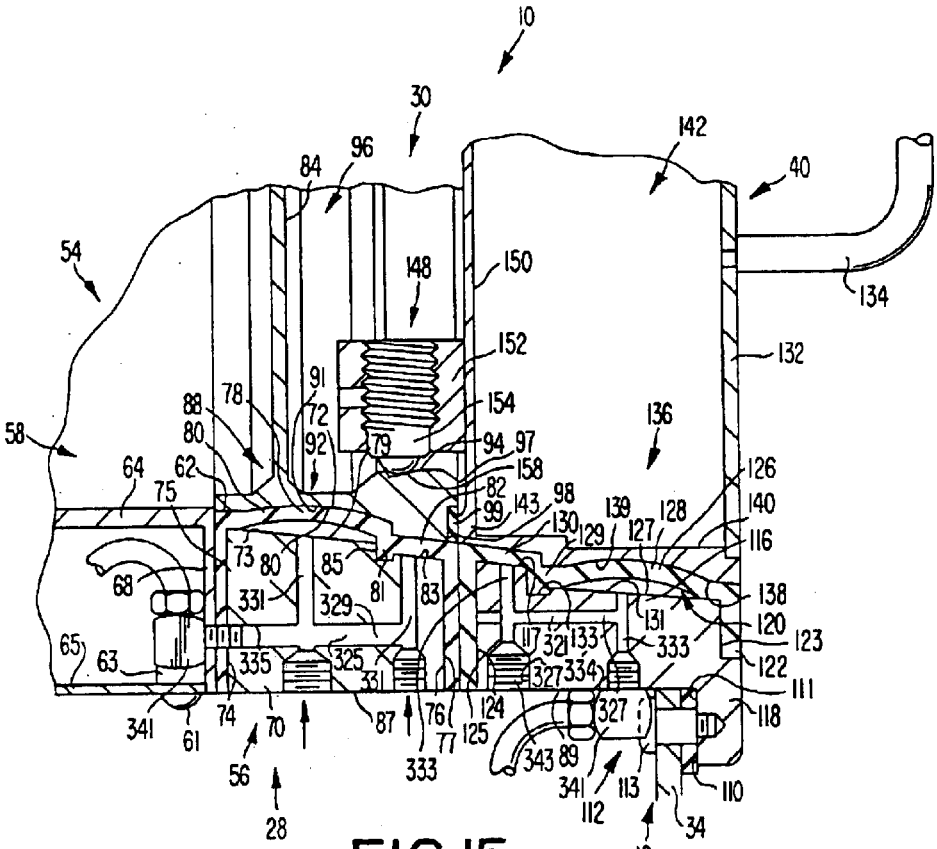
FIG. 15 is an enlarged sectional view of a portion of FIG. 3A showing a set of air conduits formed in the seal supports included in the canister and isolator door frames and filled with pressurized air to flex and expand seal members included in those door frames to establish airtight sealing engagement with annular perimeter grooves formed in the canister and isolator doors.

In a preferred embodiment, seal member 72 is "inflated" or expanded using pressurized air to urge an inner surface of seal member 72 against canister door 30 to hold door 30 in place in canister door frame 56 as shown, for example, in FIG. 15. Seal member 72 is "deflated" or contracted using a vacuum source to pull the inner surface of seal member 72 away from canister door 30 to release door 30 from a retained position in canister door frame 56 as shown, for example, in FIG. 16. A pneumatic system 210 for generating and applying pressurized air and vacuum to seal member 72 is described herein and shown, for example, in FIG. 17.

In the illustrated embodiment, back ring 74, front ring 76, and annular ledge 81 of inner ring 78 are bonded to respective back rim surface 75, front rim surface 77, and annular groove portion 85 of inner ring surface 79 of support ring 70. First and second frustoconical surfaces 80, 82 are not bonded to seal support ring 70. By providing this bonding arrangement and using a flexible material in seal member 72, first and second frustoconical surface 80, 82 will respond to pressures applied to the inner surface of seal member 72 as described herein.

Figure 3A:
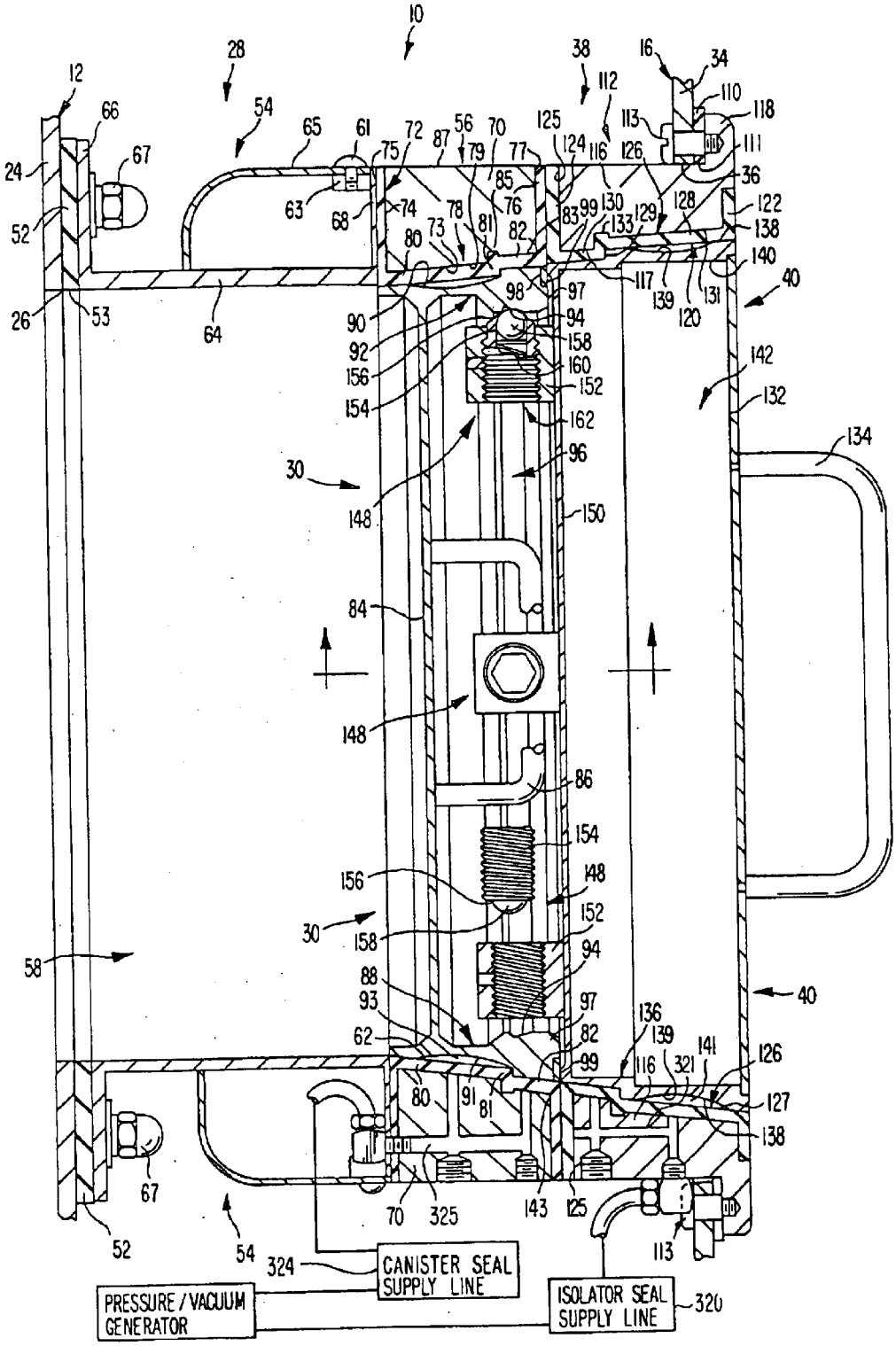
FIG. 3A is a sectional view of the components shown in FIGS. 1 and 2 after they have been assembled to form the canister and isolator portions and the canister and isolator portions have been mated to form the transfer port apparatus and showing both of the canister door and isolator door in their closed positions closing a transfer conduit providing a passageway extending horizontally through the transfer port apparatus and interconnecting the "left-side" canister chamber and the "right-side" isolation chamber and showing spring-loaded ball detents arranged to couple the isolator door to the canister door to form a removable conduit closure when both doors are mounted in their passageway-closing positions in the transfer conduit of the transfer port apparatus.

Canister door 30 includes a closure plate 84, a pair of handles 86 coupled to an outer surface of closure plate 84, and a rim 88 around an outer edge of closure plate 84. Rim 88 has an outer surface 90 configured to mate with and seal against inner ring 78 of seal member 72 when canister door 30 is mounted to close central opening 58 in canister door frame 56. For example, rim 88 engages second frustoconical surface 82, annular ledge 81, and a portion of first frustoconical surface 80 as shown in FIG. 3A. Outer surface 90 includes concave face 91 which cooperates with first frustoconical surface 80 of seal member 72 to define a chamber 93 therebetween. As described herein, the first frustoconical surface 80 can be exposed to pressurized air and moved in chamber 93 to engage concave face 91 of outer surface 90 to hold canister door 30 in canister door frame 56 and to facilitate establishment of an airtight seal between canister door frame 56 and canister door 30 as shown, for example, in FIG. 15. Second frustoconical surface 82 can also be exposed to pressurized air as shown in FIG. 15 to substantially seal and hold door 30 in frame 56.

Rim 88 on canister door 30 also-has an inner surface 92 formed to include a groove 94 sized to engage a spring-loaded ball detent-type latch member 148 mounted on an underside 150 of isolator door 40 as shown in FIG. 3A. Inner surface 92 of rim 88 and closure plate 84 cooperate to define a cavity 96 containing handles 86 and having an opening facing toward isolator portion 38. Rim 88 also includes a front face 97 formed to include an annular channel 98 containing an annular gasket 99 made of sealing material and adapted to mate with and seal against isolator portion 38 upon coupling canister portion 28 to isolator portion 38 as shown, for example, in FIG. 3A.

Isolator portion 38 of transfer port apparatus 10 includes a gasket 110 formed to include a central opening 111 and made of a sealing material, an isolator door frame 112 formed to include a central opening 115 and coupled to isolator wall 34 at opening 36 by connectors 113, and isolator door 40 configured and sized to open and close central opening 115 formed in isolator door frame 112. Central opening 115 defines an isolator passageway communicating with isolation chamber 18. In a presently preferred embodiment, each of gasket 110, isolator door frame 112, and isolator door 40 have a somewhat rectangular or oblong ring shape.

Isolator door frame 112 includes a seal support ring 116, a mounting flange 118 appended to seal support ring 116, and a seal member 120 carried on seal support ring 116. Seal member 120 is configured to establish substantially airtight sealing engagement with isolator door 40 when isolator door 40 is mounted to close central opening 115 in isolator door frame 112 and with canister door frame 56 of canister portion 28 when isolator portion 38 is mated with canister portion 28. Seal support ring 116 and mounting flange 118 are made of aluminum and seal member 120 is made of a flexible, expansible, plastic material such as HYPALON material.

Seal member 120 includes a back ring 122, a front ring 124 positioned to lie in axially spaced-apart parallel relation to back ring 122, and an inner ring 126 interconnecting inner edges of back and front rings 122, 124. Inner ring 126 is configured to mate with and seal against isolator door 40 upon insertion of isolator door 40 into central aperture 115 formed in isolator door frame 112. In the illustrated embodiment, inner ring 126 includes first frustoconical section providing section providing surface 128, second frustoconical section providing surface 130, and an annular ledge 129 lying between and interconnecting surfaces 128 and 130.

Likewise, seal support ring 116 includes a back rim surface 123, a front rim surface 125 positioned to lie in axially spaced-apart parallel relation to back rim surface 123, an inner ring surface 127 interconnecting inner edges of back and front rim surfaces 123, 125, and an outer ring surface 89 spaced apart from inner ring surface 127. In the illustrated embodiment, inner ring surface 127 includes a first portion 117, a second portion 131, and an annular groove portion 133 positioned to lie between and interconnect portions 117, 131

Inner ring 126 of seal member 120 completely covers inner ring surface 127 of support ring 116 to form a one-piece covering over inner ring surface 127. Because inner ring 126 provides a one-piece covering, seal member 120 is easy to clean because there are not multiple pieces of material to clean.

In a preferred embodiment, seal member 120 is "inflated" or expanded using pressurized air to urge an inner surface of seal member 120 against isolator door 40 in place in isolator door frame 112 as shown, for example, in FIG. 15. Seal member 120 is "deflated" or contracted using a vacuum source to pull inner surface of seal member 120 away from isolator door 40 from a retained position in isolator door frame 112 as shown, for example, in FIG. 16. Pneumatic system 210 generates and applies pressurized air and vacuum to isolator seal member 120 as well as to canister seal member 72.

In the illustrated embodiment, back ring 122, front ring 124, and annular ledge 129 of inner ring 78 are bonded to respective back rim surface 123, front rim surface 125, and annular groove portion 133 of inner ring surface 127 of seal support ring 116. First and second frustoconical surfaces 128, 130 are not bonded to seal support ring 116. By providing this bonding arrangement and using a flexible material in seal member 120, first and second frustoconical surfaces 128, 130 will respond to pressures applied to the inner surface of seal member 120 as described herein.

Isolator door 40 includes a closure plate 132, a pair of handles 134 coupled to an inner surface of closure plate 132, and a rim 136 around an outer edge of closure plate 132. Rim 136 has an outer surface 138 configured to mate with and seal against inner ring 126 of seal member 120 when isolator door 40 is mounted to close central opening 115 in isolator door frame 112. For example, rim 136 engages second frustoconical surface 130, annular ledge 129, and a portion of first frustoconical surface 128 as shown in FIG. 3A. Outer surface 138 includes annular concave face 139 which cooperates with first frustoconical surface 128 of seal member 120 to define a chamber 141 therebetween. As described herein, first frustoconical surface 128 can be exposed to pressurized air and moved in chamber 141 to engage annular concave face 139 of outer surface 138 to hold isolator door 40 in isolator door frame 112 and to facilitate establishment of an airtight seal between isolator door frame 112 and isolator door 40 as shown, for example, in FIG. 15. Second frustoconical surface 130 can also be exposed to pressurized air as shown in FIG. 15 to substantially seal and hold door 40 in frame 112.

Closure plate 132 and an inner surface 140 of rim 136 cooperate with underside 150 of isolator door 40 to define a closed cavity 142. Underside 150 of isolator door 40 includes a perimeter lip 143 arranged to mate with annular gasket 99 carried on canister door 30 upon mating engagement of doors 30, 40 as shown in FIG. 3A. When isolator door 40 is mated with canister door 30, annular gasket 99 provides a substantial seal therebetween to seal off cavity 96 of canister door 90.

A hinge 144 is provided to couple isolator door 40 to isolator 16 to facilitate movement of isolator door 40 in isolation chamber 18 between a closed position in isolator door frame 112 and an opened position away from central opening 115 in isolator door frame 112 as shown, for example, in FIGS. 4–14. Hinge 144 includes several hinge links 146 and each hinge link 146 includes one end pivotably coupled to isolator door 40 and another end pivotably coupled to bottom wall 44 of isolator 16. Movement of isolator door 40 toward and away from isolator door frame 112 during opening and closing of isolator door 40 is controlled by hinge links 146 as shown, for example, in FIGS. 5, 8, and 13. Hinge links 146 aid in repositioning canister door 30 (coupled to isolator door 40 coupled to hinge links 146) in a proper closure position relative to central opening 58 in canister door frame 112 during movement of doors 30, 40 toward closure positions in transfer port apparatus 10 as shown, for example, in FIG. 13.

Latch members 148 are mounted on isolator door 40 and configured to latch isolator door 40 to canister door 30 to retain isolator door 40 in sealing engagement with isolator door frame 112 when canister door 30 is mounted in central opening 62 of canister door frame 56 and isolator door 40 is mounted in central opening 115 of isolator door frame 112. In the illustrated embodiment, each latch member 148 is a releasable spring-loaded detent coupled to underside 150 of isolator door 40 and configured to engage groove 94 formed in inner surface 92 of canister door rim 88 as shown in FIG. 3A.

Figure 3B:
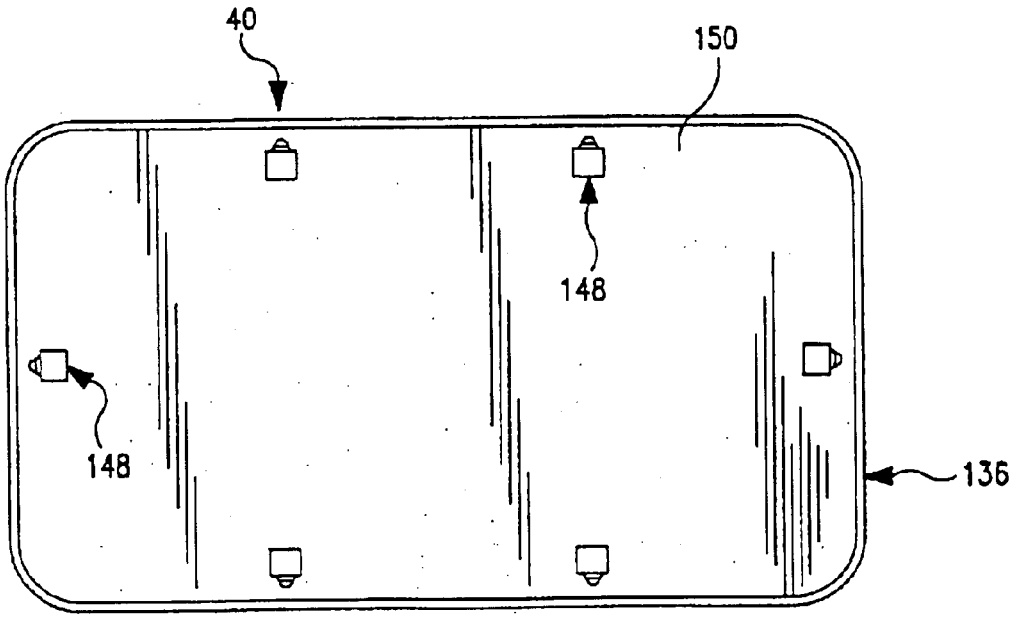
FIG. 3B is a top plan view of the isolator door showing the arrangement of the spring-loaded ball detents.

As shown in FIG. 3A, latch member 148 includes a base 152 fixed to underside 150 of isolator door 40 and a ball retainer 154 coupled to base 152 and formed to include an opening 156 positioned to lie in close proximity and confronting relation to groove 94 in canister door 30 upon placement of isolator door 40 in central opening 115 of isolator door frame 112. Latch member 148 also includes a ball 158 mounted for movement in a passageway formed in ball retainer 154 to communicate with opening 156 and a yieldable spring 160 arranged to bias ball 158 in passageway through opening 156 into groove 94 and engagement with rim 88 of canister door 30 so as to establish a releasable latching connection of isolator door 40 to canister door 30. Ball retainer 154 includes an outer surface end configured to engage threads formed in an aperture 162 formed in base 152 to facilitate adjustment of the position of ball retainer 154 and spring-biased ball 158 relative to groove 94 in canister door 30 during latching of isolator door 40 to canister door 30. Latch members 148 are commercially available ball plungers. The arrangement of latch members 148 on isolator door 40 is shown in FIG. 3B.

Figure 14:
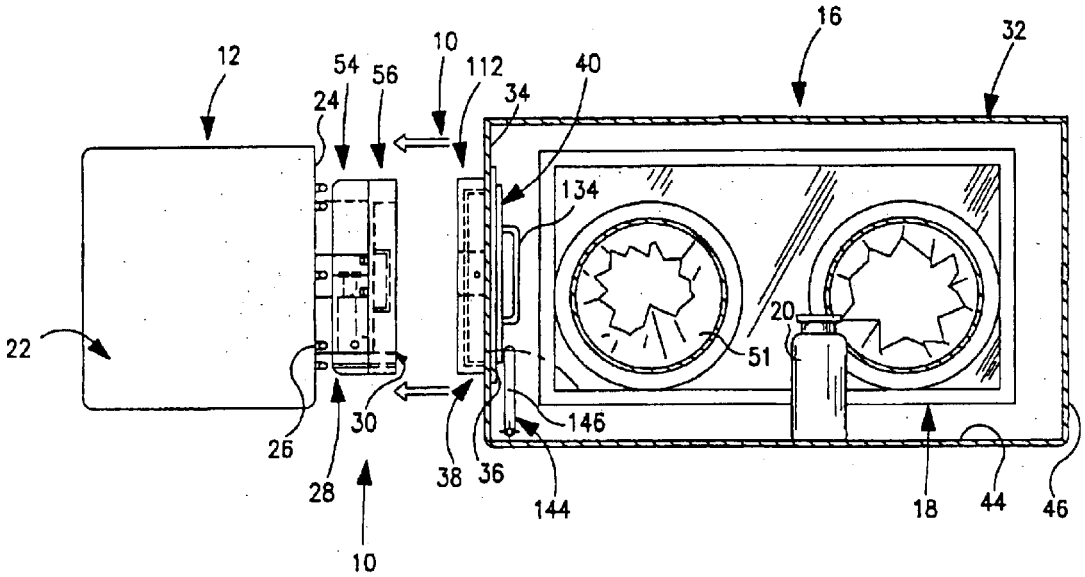
FIG. 14 is a view similar to FIG. 13 showing disengagement of the canister portion from the isolator portion after reinstallation of the canister door in the canister portion and the isolator door in the isolator portion.

Use of transfer port apparatus 10 to transfer object 20 from canister chamber 14 in movable canister 12 into isolation chamber 18 in isolator 16 is shown, for example, in FIGS. 4–13 and later disengagement of canister 12 from isolator 16 following such transfer is shown in FIG. 14. Use of a pneumatic system 210 to inflate canister seal member 72 in canister door frame 56 to hold canister door 30 in canister door frame 56 and assist in establishing an airtight seal against canister door 30 and to inflate isolator seal member 120 in isolator door frame 112 to hold isolator door 40 in isolator door frame 112 and assist in establishing an airtight seal against isolator door 40 is shown diagrammatically in FIGS. 17–24.

Figure 4:
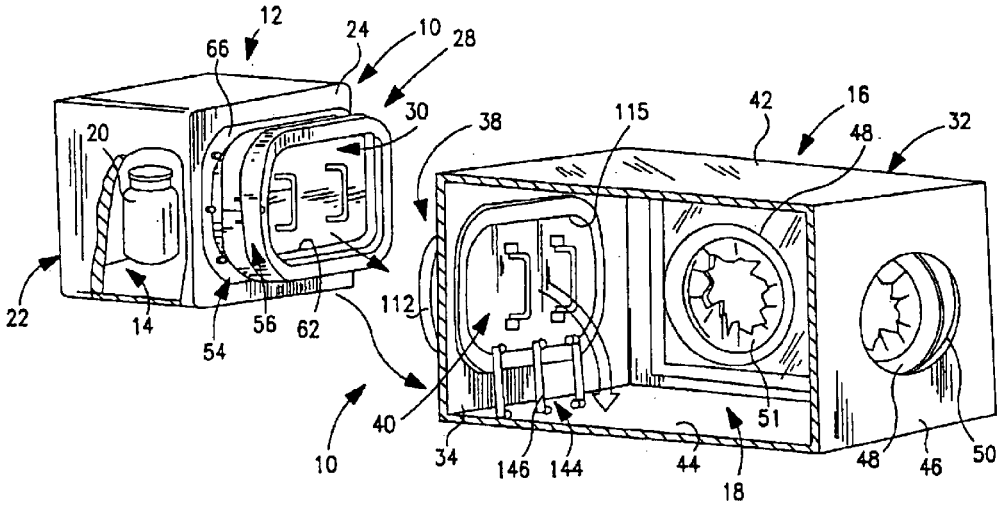
FIG. 4 is a perspective view of a "loaded" canister containing a bottle and an "empty" isolator prior to mating engagement of the canister portion (appended to the canister) arid the isolator portion (appended to the isolator) to establish the assembled transfer port apparatus and showing both of the canister door and the isolator door in a closed and sealed position to maintain airtight clean working environments in the canister chamber and the isolation chamber.
Figure 5:
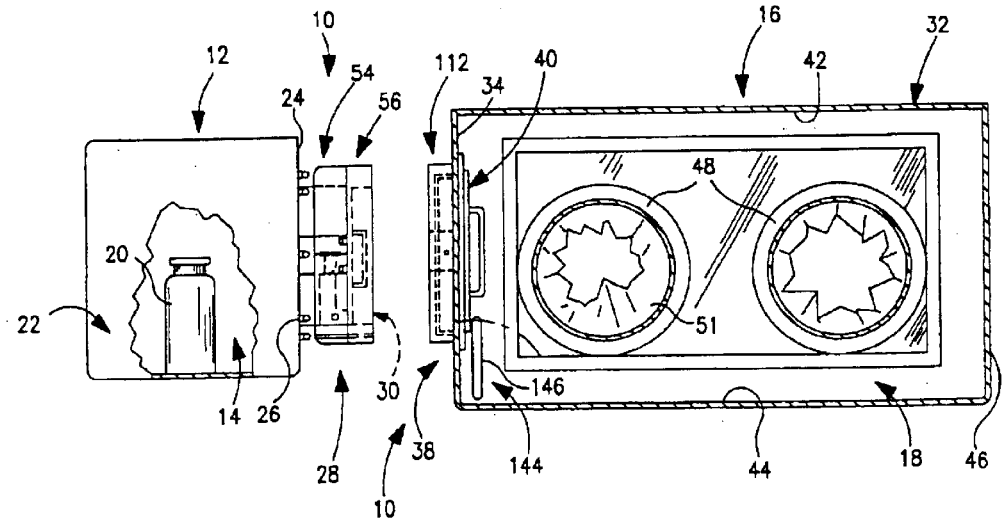
FIG. 5 is a side elevation view of the apparatus shown in FIG. 4.

Referring to FIGS. 4 and 5, canister 12 containing object 20 in airtight chamber 14 is moved to lie next to stationary isolator 16 having an empty isolation chamber 18. Canister door 30 is mounted in canister door frame 56 included in canister portion 28 of transfer port apparatus 10 to close central opening 62 in canister door frame 56 and establish an airtight seal against canister door frame 56 to maintain an airtight clean environment in canister chamber 14 formed in movable canister 12. Canister 12 can be moved about easily to enable a worker (not shown) to transport object 20 in an uncontaminated sterile environment to and from isolator 16. Isolator door 40 is mounted in isolator door frame 112 included in isolator portion 38 of transfer port apparatus 10 to close central opening 115 in isolator door frame 112 and establish an airtight seal against isolator door frame 112 to maintain an airtight clean working environment in isolator chamber 18 formed in stationary isolator 16.

Figure 6:
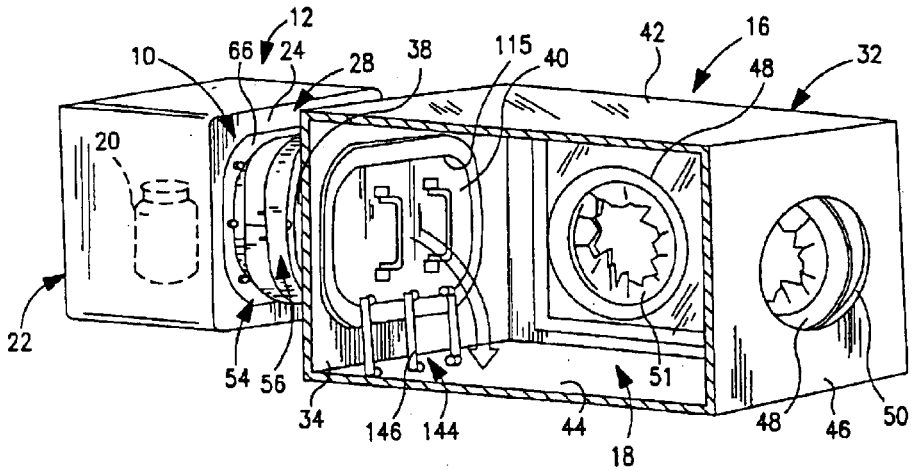
FIG. 6 is a perspective view similar to FIG. 4 showing coupling of the canister portion to the isolator portion to establish the transfer port apparatus.
Figure 7:
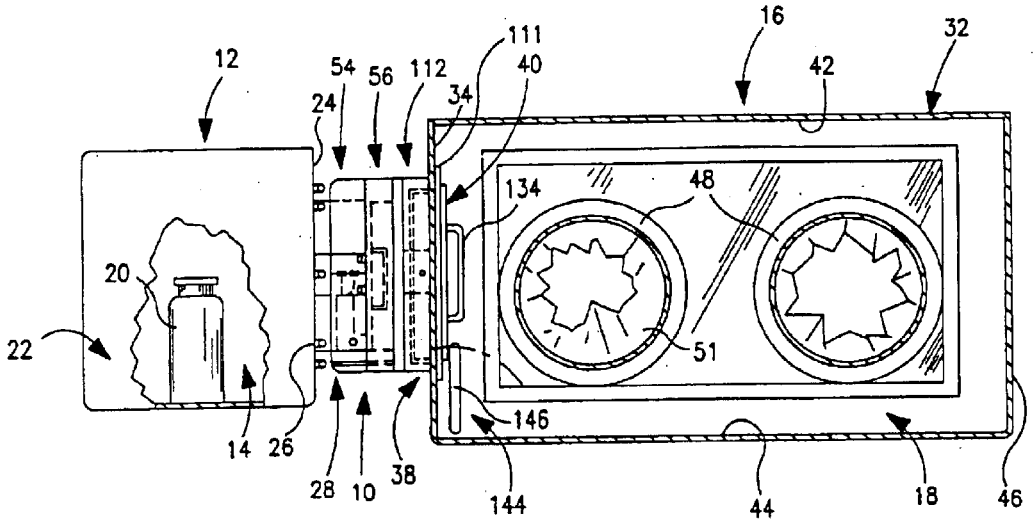
FIG. 7 is a side elevation view of the apparatus shown in FIG. 6.
Figure 8:
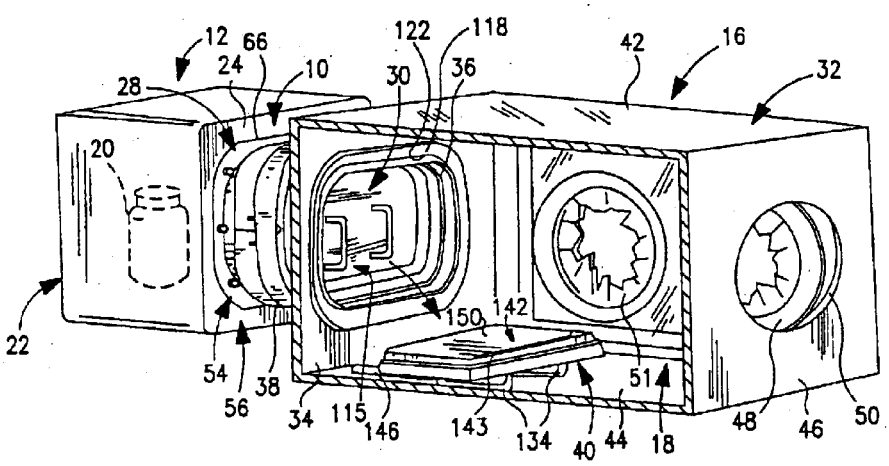
FIG. 8 is a perspective view similar to FIGS. 4 and 6 showing the isolator door after it has been moved to an opened position to open a passageway formed in the isolator portion of the transfer port apparatus and expose handles on the still-closed canister door to a worker accessing the isolation chamber in the isolator through the two access ports formed in a rear side wall of the isolator.

Referring now to FIGS. 4, 6, and 8, canister portion 28 is coupled to isolator portion 38 to establish transfer port apparatus 10 having one end connected to canister 12 at opening 26 and an opposite end connected to isolator 16 at opening 111. Both doors 30, 40 remain in their closed and sealed positions in their respective door frames 56, 112 to close the passageway extending from canister chamber 14 in canister 12 to isolation chamber 18 in isolator 16 through transfer port apparatus 10.

Figure 9:
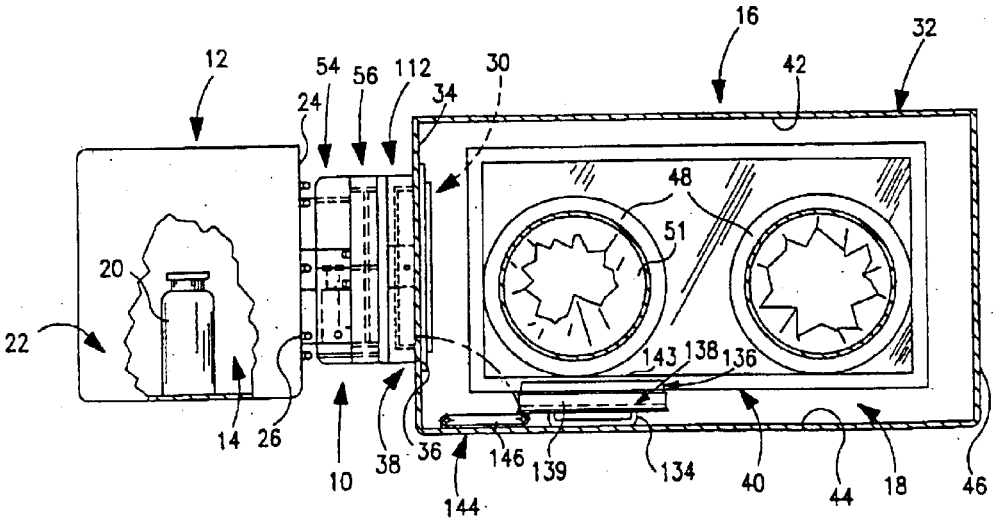
FIG. 9 is a side elevation view of the apparatus shown in FIG. 8.

Referring now to FIGS. 8 and 9, isolator door 40 has been pivoted on hinge 144 by a worker (not shown) accessing isolator door 40 in isolation chamber 18 through access ports 48 to an opened position lying on bottom wall 44 in isolation chamber 18 to open central opening 115 in isolator door frame 112. Canister door 30 is now accessible to the worker through central opening 115. At this stage, however, canister door 30 remains in its closed and sealed position in canister door frame 56 to close the passageway extending from canister chamber 14 through canister portion 28 of transfer port apparatus 10.

Referring now to FIGS. 10 and 11, canister door 30 has been moved to an opened position and coupled to isolator door 40 by latch members 148 to open central opening 62 in canister door frame 56. The transfer conduit or passageway formed in transfer port apparatus 10 is now opened to interconnect canister chamber 14 and isolation chamber 18 in fluid communication to enable a worker to move bottle 20 from canister chamber 14 into isolation chamber 18 through that transfer conduit as shown in FIG. 12. Canister door 30 can also be latched to isolator door 40 and removed simultaneously with isolator door 40.

Once object 20 has been moved into isolation chamber 18 as shown in FIG. 13, canister door 30 and isolator door 40 can be returned to passageway-closing positions in transfer port apparatus 10 to establish an airtight, sealed, working environment in isolation chamber 18. Canister door 30 can be returned separately or simultaneously with isolator door 40. After seal members 72, 120 have been inflated, canister portion 28 can then be disengaged from isolator portion 38 to enable a worker to separate canister 12 from isolator 16 without disrupting the uncontaminated sterile environments in canister chamber 14 and isolation chamber 18 as shown in FIG. 14.

Figure 17:
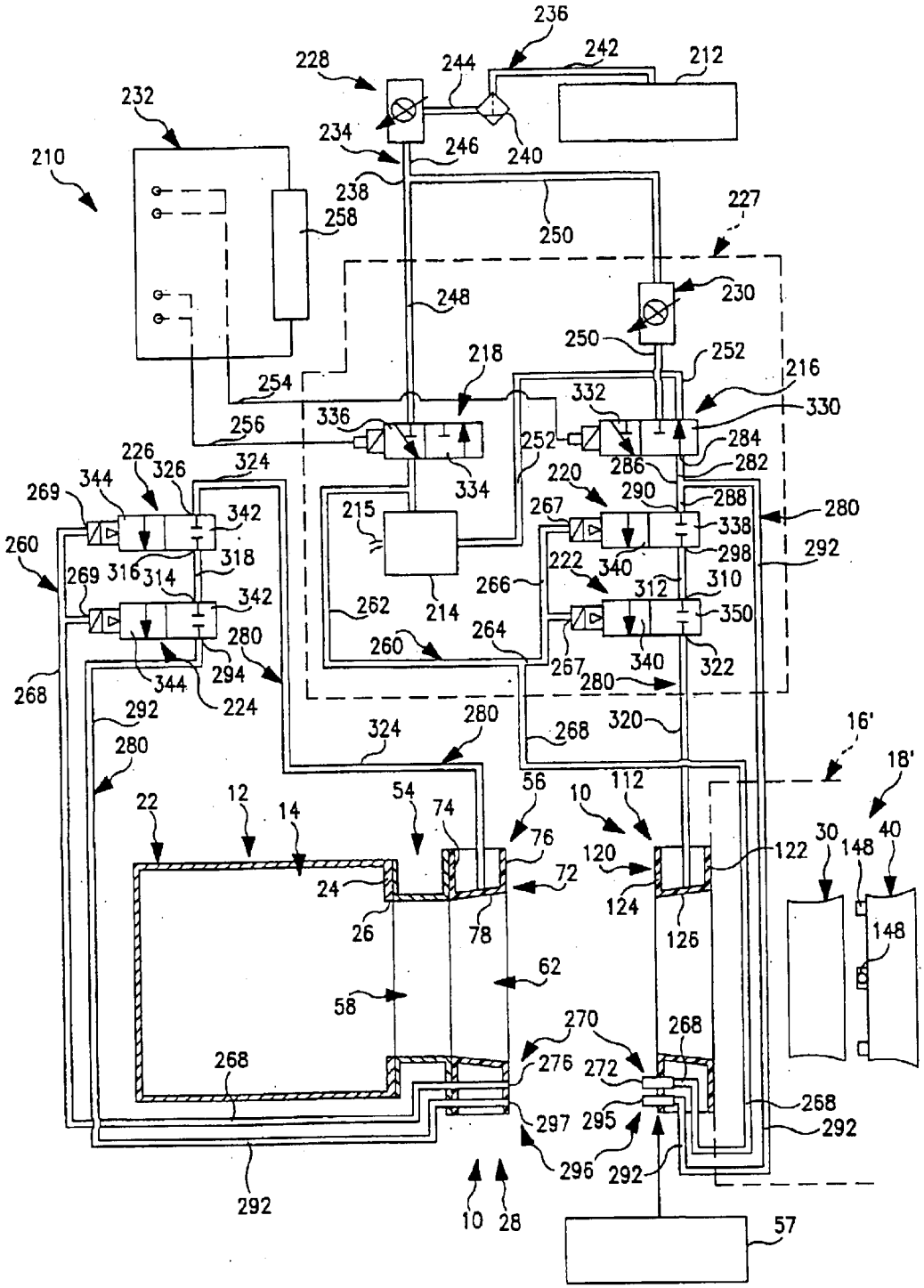
FIG. 17 is a schematic view of the canister, the isolator, the split transfer port apparatus, and a pneumatic system for selectively inflating and deflating seal members provided in the canister and isolator door frames included in the transfer port assembly.
Figure 25:
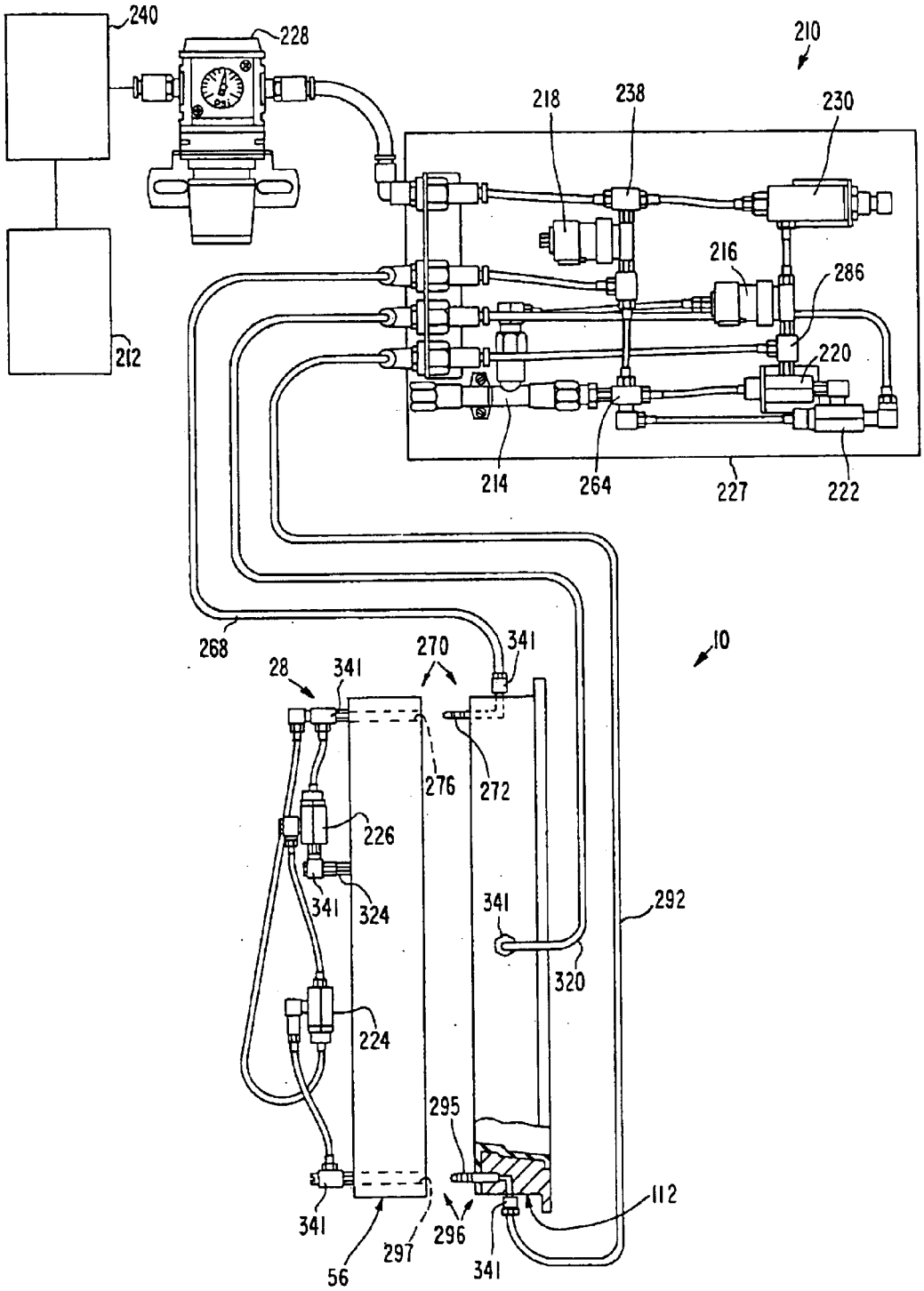
FIG. 25 is a side view of the canister door frame, the isolator door frame, and the pneumatic system coupled to a pneumatic board showing the configuration of the valves, supply lines, and other components of the pneumatic system.

Pneumatic pressure is controlled and delivered to inflate and deflate seal members 72, 120 by a pneumatic system 210, a preferred embodiment of which is shown diagrammatically in FIG. 17. Pneumatic system 210 includes a positive pressure (compressed air) supply 212, a vacuum supply 214, a pressure selector valve 216, a master valve 218, a pair of isolator slave valves 220, 222, a pair of canister slave valves 224, 226, a filter regulator 228, a supply regulator 230, and an electrical circuit 232 for controlling operation of pressure selector valve 216 and master valve 218. Pressure selector valve 216 and master valve 218 are commercially available solenoid valves and slave valves 220, 222, 224, 226 are commercially available pilot valves. It is understood, however, that a wide variety of commercially available valves may be used in pneumatic system 210 in accordance with the present invention. Many of the components in pneumatic system 210 are mounted on a pneumatics board 227 shown diagrammatically in FIG. 17 and illustratively in FIG. 25. In a preferred embodiment, electrical circuit 232 is mounted on the backside of pneumatics board 227.

As shown in FIG. 17, pneumatic system 210 further includes a series of pneumatic supply lines fluidly connecting positive pressure supply 212 and vacuum supply 214 to pressure selector valve 216, master valve 218, isolator slave valves 220, 222, canister slave valves 224, 226, seal member 72 in canister door frame 56, and seal member 120 in isolator door frame 112. The pneumatic supply lines in pneumatic system 210 include a positive pressure supply line 234 including a main branch 236 that conducts pressurized air from positive pressure supply 212 to a junction 238 through a filter dryer 240 and filter regulator 228 via conduits 242, 244, and 246. Filter regulator 228 regulates the pressure of air discharged through conduit 256 to junction 238 to within an acceptable predetermined pressure range. Filter dryer 240 removes water from pneumatic system 210. The pneumatic supply lines in pneumatic system 210 further include a master branch 248 that conducts pressurized air from junction 238 to master valve 218 and a pressure supply branch 250 that conducts pressurized air from junction 238 to pressure selector valve 216 through supply regulator 230. The pneumatic supply lines in pneumatic system 210 also include a vacuum supply line 252 that supplies negative pressure from vacuum supply 214 to pressure selector valve 216.

Circuit 232 controls operation of pressure selector and master valves 216, 218 to regulate the flow of pressurized air from positive pressure supply 212 and vacuums generated by vacuum supply 214 to seal member 72 in canister door frame 56 and to seal member 120 in isolator door frame 112. Circuit 232 is wired to pressure selector valve 216 through a lead 254 and master valve 218 through a lead 256. A user of transfer port apparatus 10 inputs commands into a control panel 258 coupled to circuit 232 to control the operation of pressure selector and master valves 216, 218.

Figure 16:
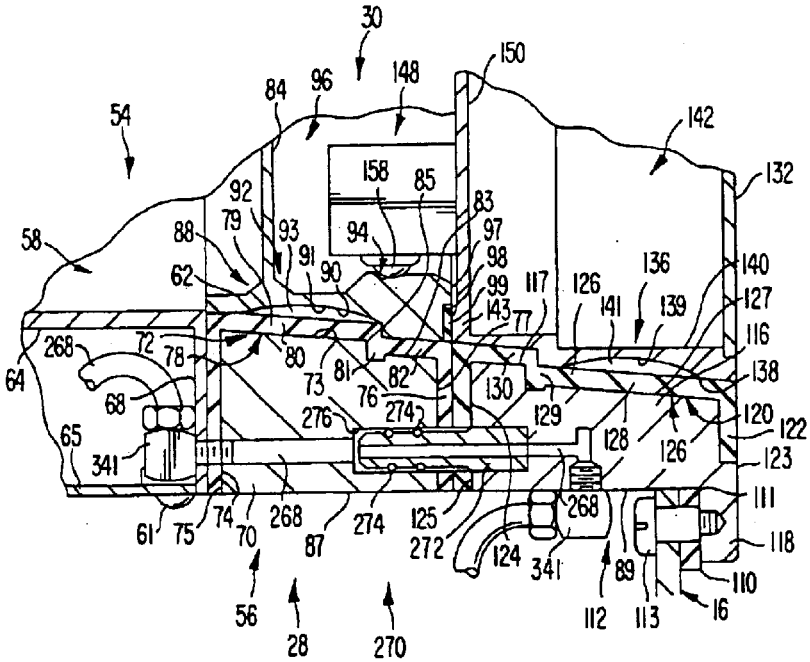
FIG. 16 is a view similar to FIG. 15 of a system for distributing pressurized air and vacuum through a pneumatic junction or connecter in the canister and isolator door frames to reach the seal members included in the canister door frames.

In one embodiment, the series of pneumatic supply lines in pneumatic system 210 further include a slave supply line 260 including a main branch 262 that provides negative pressure from vacuum supply 214 to a junction 264, an isolator branch 266 that provides negative pressure from junction 264 to control ports 267 of isolator slave valves 220, 222, and a canister branch 268 that provides negative pressure from junction 264 to control ports 269 of canister slave valves 224, 226 through a pneumatic junction 270. As shown in FIG. 16, pneumatic junction 270 includes pneumatic couplings 341, a hollow pin 272, a plurality of O-rings 274 coupled to an exterior wall of hollow pin 272 and a pin-receiving aperture 276 formed in support ring 70 of canister door frame 56. When canister 12 is coupled to isolator 16, pin 272 is aligned with and inserted into pin-receiving aperture 276 so that O-rings 274 form a seal between pin 272 and support ring 70.

As shown in FIG. 17, the series of pneumatic supply lines in pneumatic system 210 further include a pressure supply line 280 including a main branch 282 that provides pressure from an outlet port 284 on pressure selector valve 216 to a junction 286, an isolator branch 288 that provides pressure from junction 286 to an inlet port 290 on first isolator slave valve 220, and a canister branch 292 that provides pressure from junction 286 to an inlet port 294 on first canister slave valve 224 through a pneumatic junction 296. Pneumatic junction 296 of pressure supply line 192 is similar in construction to pneumatic junction 270 of slave supply line 260.

Referring to FIG. 17, first isolator slave valve 220 is pneumatically coupled to second isolator slave valve 222 from an outlet port 298 on first isolator slave valve 220 to an inlet port 310 on second isolator slave valve 222 through a line 312. Likewise, first canister slave valve 224 is pneumatically coupled to second container slave valve 226 from an outlet port 314 on first container slave valve 224 to an inlet port 316 on second container slave valve 226 through a line 318. First and second isolator slave valves 220, 222 are arranged in series so that if one of valves 220, 222 fails, the other of valves 220, 222 will function. Likewise, first and second canister slave valves 224, 226 are arranged in series so that if one of valves 224, 226 fails, the other of valves 224, 226 will function.

Pressure supply line 280 further includes an isolator seal supply line 320. Supply line 320 provides pressure from an outlet port 322 on second isolator slave valve 222 to isolator seal member 120 through passageways 321 formed in support ring 116 of isolator door frame 112 and a canister seal supply line 324 that provides pressure from an outlet port 326 on second container slave valve 226 to canister seal member 72 through passageways 325 formed in support ring 70 of canister door frame 56. These passageways 321, 325 are shown, for example, in FIGS. 3A and 15.

Air conduits such as passageways 321, 325 are formed in isolator and canister door frames 112, 56 through a series of machining operations to include respective main segments 327, 329 and branch segments 331, 333 as shown in FIG. 15. Main segments 327, 329 are formed by drilling into front rim surface 125 of respective support ring 116 of isolator door frame 112 and back rim surface 75 of support ring 70 of canister door frame 56 to create openings 335. Likewise, branch segments 331, 333 are formed by drilling into outer ring surfaces 89, 87 of respective support rings 116, 70 of isolator and canister door frames 112, 56 creating first and second openings 337, 339.

Passageways 321, 325 are coupled to pneumatic system 210 by couplings 341 to permit the delivery of pressurized air to canister and isolator seal members 72, 120. A coupling 341 is inserted into opening 335 of canister door frame 56 to deliver air from canister seal supply line 324 as shown in FIG. 15. Opening 335 of isolator door frame 112 is welded shut. Another coupling 341 is inserted into second opening 339 of isolator door frame 112 to deliver air from isolator seal supply line 320 as shown in FIG. 15. First openings 337 of canister and isolator door frames 112, 56 and second opening 339 of canister door frame 56 are sealed by set screw-like plugs 343.

Each of the valves included in pneumatic system 210 includes a valve body that is movable between first and second positions to couple or decouple certain of the pneumatic supply lines in pneumatic system 210. Each valve body includes two air/vacuum controller segments that are shown diagrammatically in FIGS. 17–24. These air/vacuum controller segments are arranged so that a first of the air/vacuum controller segments operate to pass or block flow of compressed air or vacuum through the valve body when the valve body is moved to its first position and a second of the air/vacuum controller segments operate to pass or block flow of compressed air or vacuum through the valve body when the valve body is moved to its second position.

Figure 18:
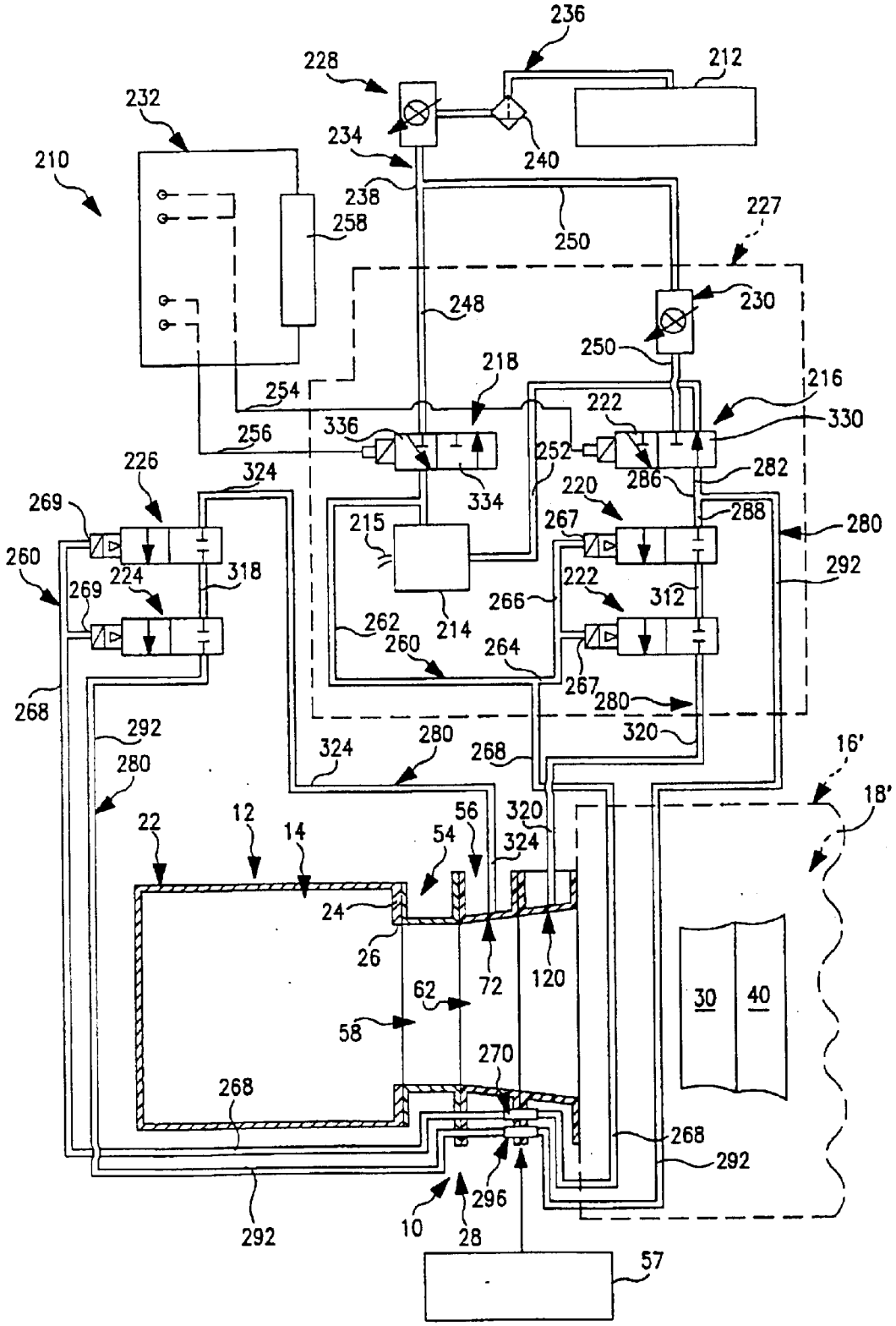
FIG. 18 is a schematic view similar to FIG. 17 showing mating of the canister and isolator door frames and the seal members included therein in their uninflated positions.

Pressure selector valve 216 includes a first controller segment 330 configured to couple vacuum supply line 252 to main branch 282 of pressure supply line 280 and "cap off" pressure supply branch 250 of positive pressure supply line 234 when pressure selector valve 216 is moved to assume its negative pressure position shown in FIGS. 17 and 18. Pressure selector valve 216 also includes a second controller segment 332 configured to couple pressure supply branch 250 of positive pressure supply line 234 to main branch 282 of pressure supply line 280 and cap off vacuum supply line 252 when pressure selector valve 216 is moved to assume its positive pressure position shown in FIG. 19A.

Figure 19A:
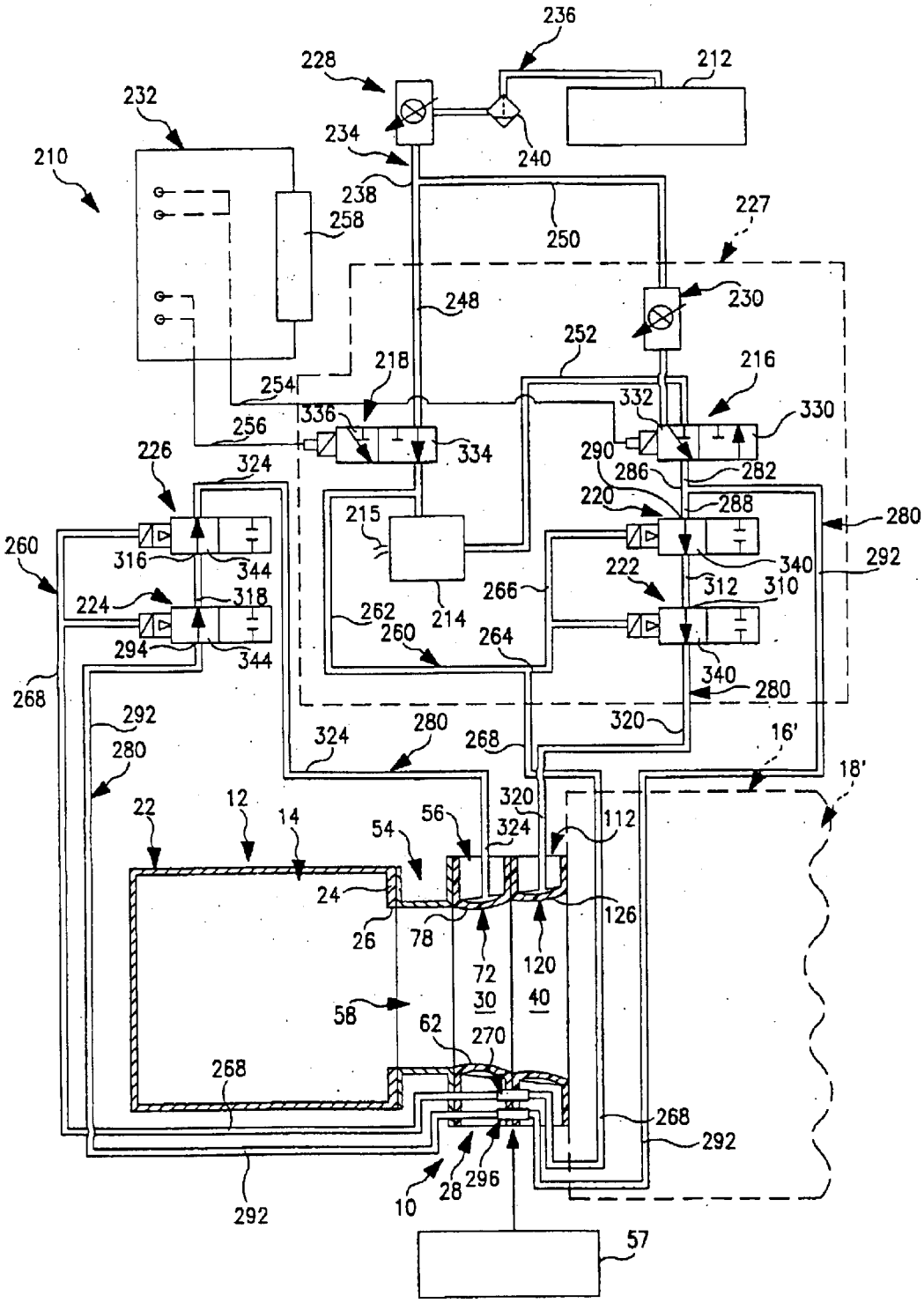
FIG. 19A is a schematic view similar to FIG. 18 showing movement of a master valve, two isolator slave valves, and two canister slave valves to opened positions and a pressure selector valve to a positive pressure position causing pressurized air to inflate the seal members mounted on the canister and isolator door frames.

Master valve 218 includes a first controller segment 334 configured to couple main branch 262 of slave supply line 260 to master branch 248 of positive pressure supply line 234 when master valve 218 is moved to assume its opened position shown in FIG. 19A. Master valve 218 also includes a second controller segment 336 configured to decouple main branch 262 of slave supply line 260 and master branch 248 of positive pressure supply line 234, cap off master branch 248, and open main branch 262 to atmosphere when master valve 218 is moved to assume its closed position shown in FIGS. 17 and 18.

Each of isolator slave valves 220, 222 includes a first controller segment 338 decoupling isolator branch 288 and isolator seal supply line 320 in pressure supply line 280 to block flow of compressed air or vacuum to isolator seal member 120 when either one of isolator slave valves 220, 222 is moved to assume its closed (first) position shown in FIG. 17. Each of isolator slave valves 220, 222 includes a second controller segment 340 coupling isolator branch 288 and isolator seal supply line 320 to permit flow of compressed air to or apply vacuum to isolator seal member 120 when both of isolator slave valves 220, 222 are moved to assume their opened (second) positions shown in FIG. 19A.

Each of canister slave valves 224, 226 includes a first controller segment 342 decoupling canister branch 292 of pressure supply line 280 and canister seal supply line 324 to block flow of compressed air or vacuum to canister seal member 72 when either one of canister slave valves 224, 226 is moved to assume its closed (first) position shown in FIG. 17. Each of canister slave valves 224, 226 includes a second controller segment 344 coupling canister branch 292 to canister seal supply line 324 to permit flow of compressed air or apply vacuum to canister seal member 72 when both of canister slave valves 224, 226 are moved to assume their opened (second) positions shown in FIG. 19A.

Figure 19B:
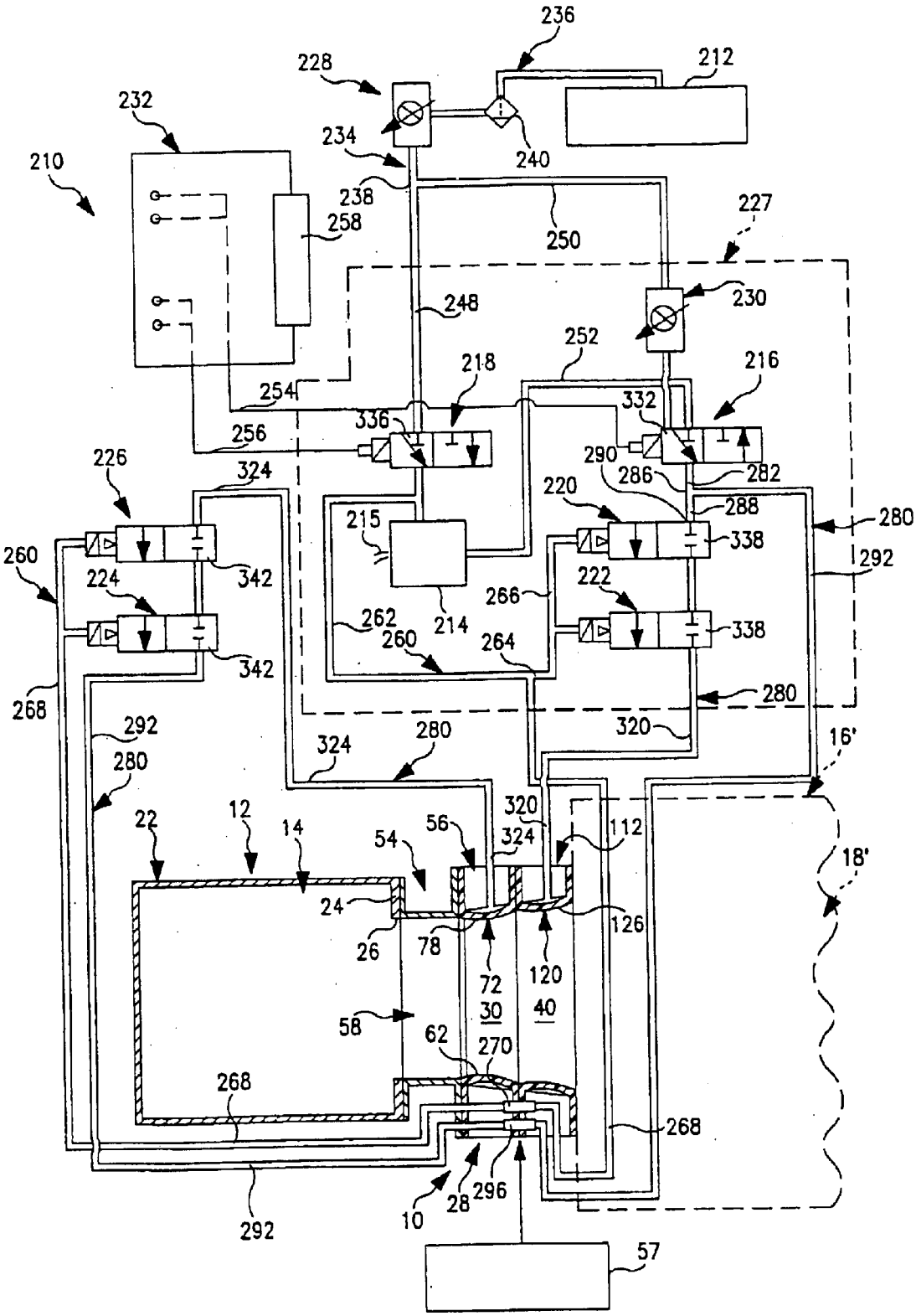
FIG. 19B is a schematic view similar to FIG. 19A showing movement of the canister and isolator slave valves back to closed positions so that pressurized air at a seal-inflating pressure is maintained in the canister and isolator supply lines to maintain the seal members mounted on the canister and isolator door frames in their inflated positions even when the canister door frame is disengaged from the isolator door frame (as shown in FIG. 20) during separation of the canister from the isolator.
Figure 20:
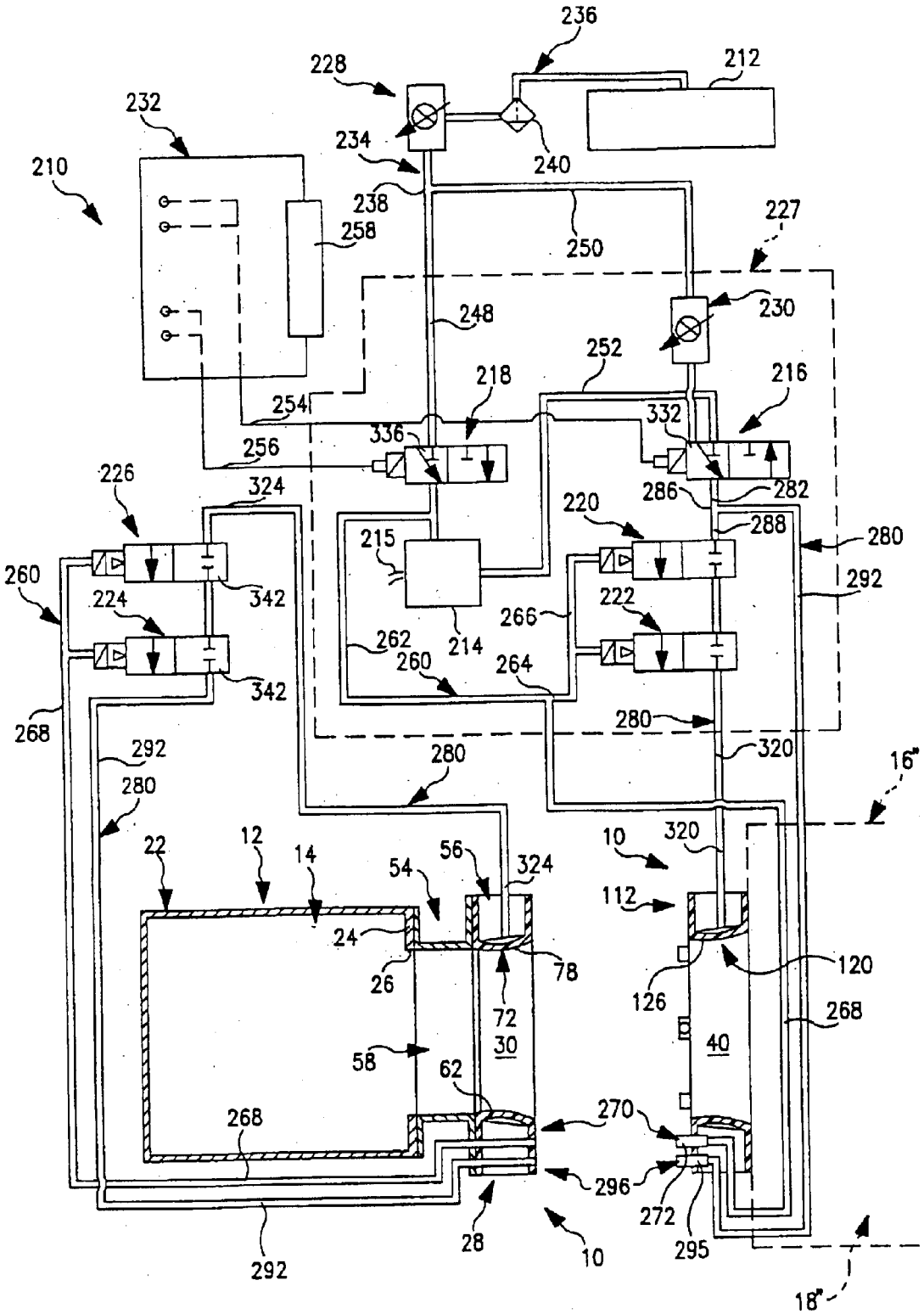
FIG. 20 is a schematic view similar to FIGS. 17–19B showing separation of the canister from the isolator without deflation of the seal members mounted on the canister and isolator door frames.
Figure 21:
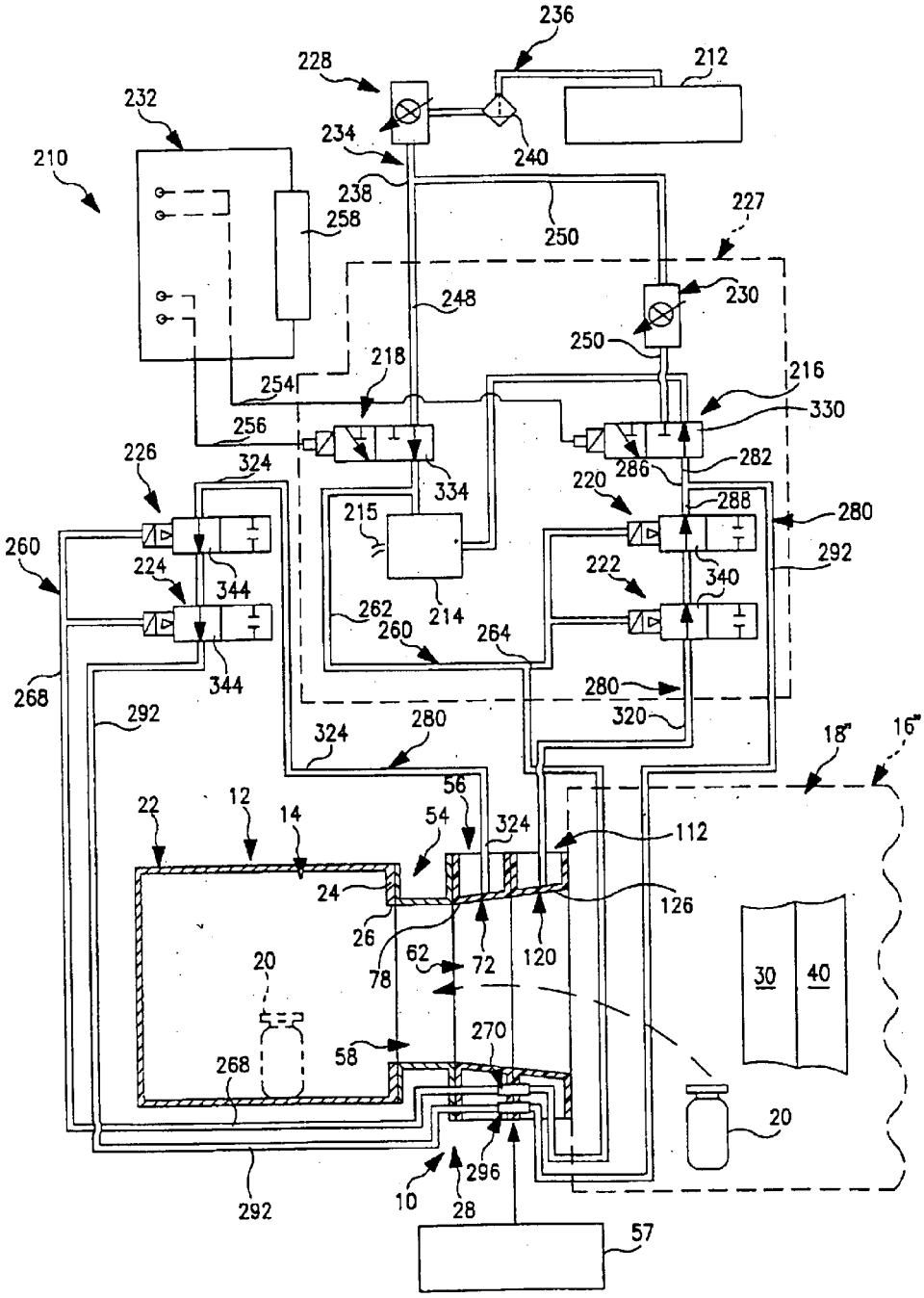
FIG. 21 is a schematic view similar to FIG. 20 showing docking of the canister to a second isolator and transfer of a bottle in the second isolator through a sealed passageway in the transfer port apparatus interconnecting the canister and the second isolator after the canister and isolator slave valves have been moved to their opened positions to cause the seal members mounted on the canister and isolator door frames to be exposed to a vacuum and deflated to permit removal of the canister and isolator doors so as to open the passageway in the transfer port apparatus.
Figure 22:
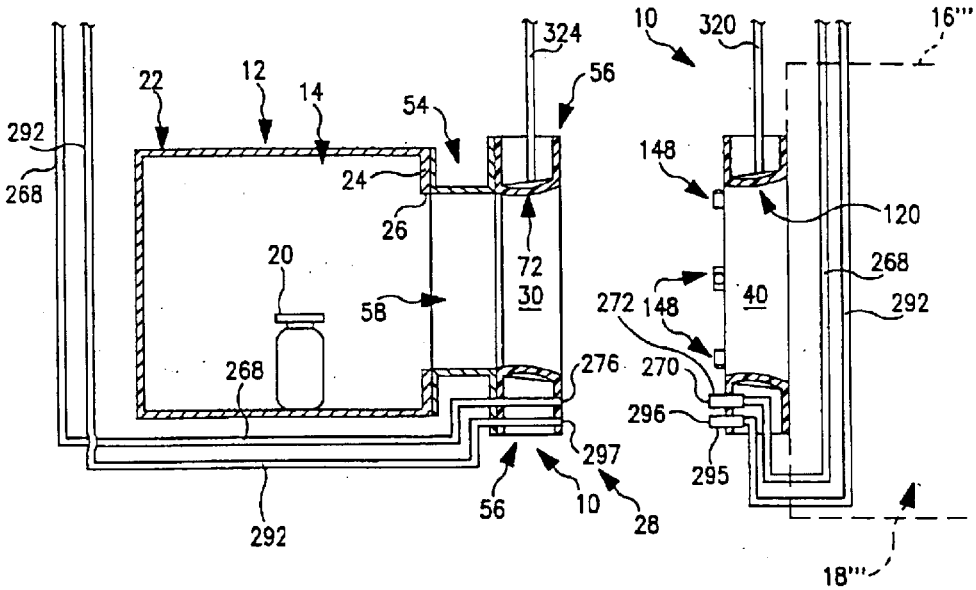
FIG. 22 is a schematic view of the canister and second isolator of FIG. 21 showing inflation of the seal members and undocking of the canister (loaded with the bottle) from the second isolator.
Figure 23:
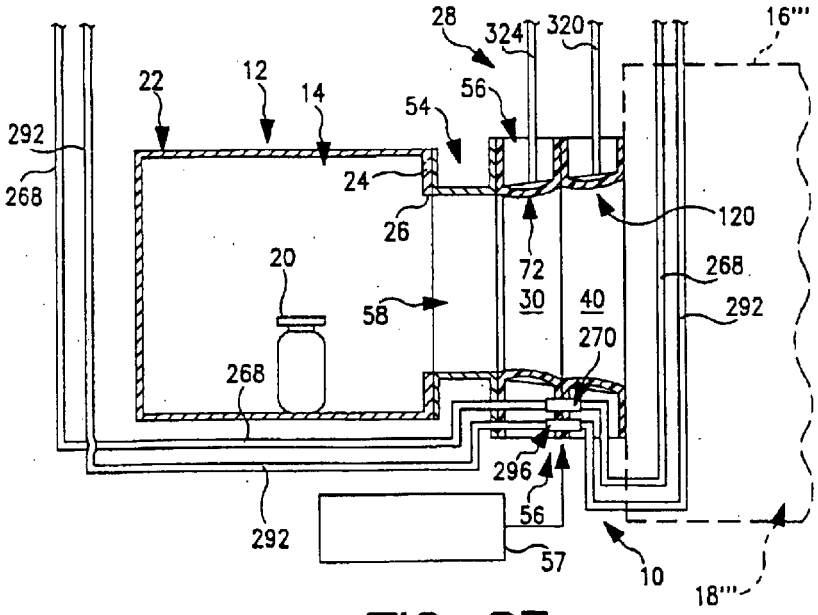
FIG. 23 is a schematic view similar to FIG. 22 showing docking of the canister to a third isolator.
Figure 24:
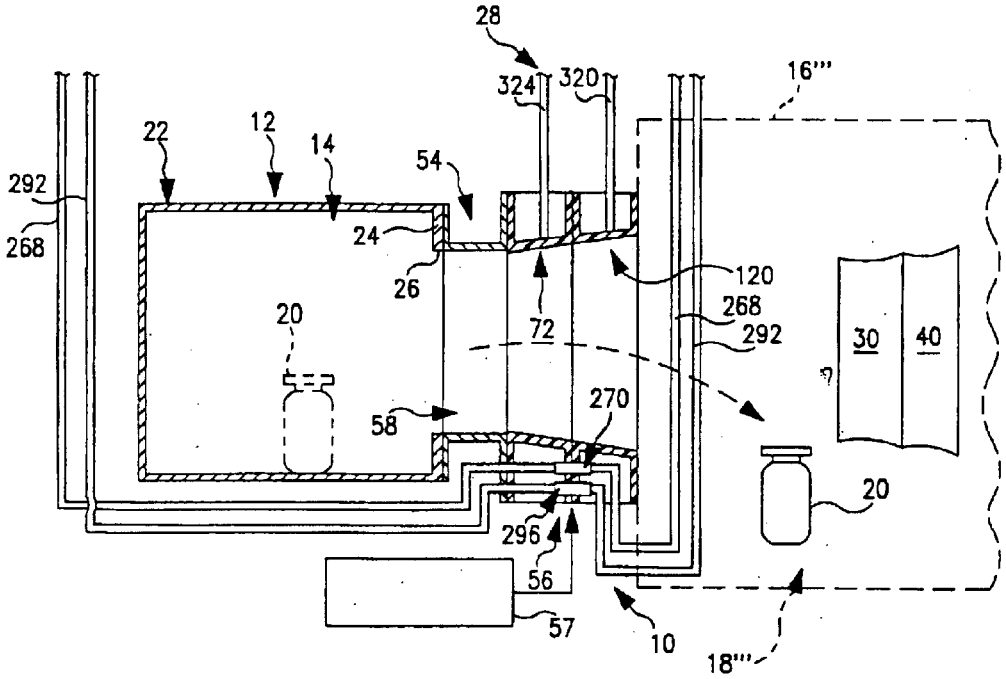
FIG. 24 is a schematic view similar to FIG. 23 showing transfer of the bottle from the canister into the third isolator through a transfer port apparatus interconnecting the canister and the third isolator.

Initial sterilization of canister 12 when coupled to an empty first isolator 16' and later use of canister 12 to receive an object 20 from a second isolator 16" and transfer that object 20 to a third isolator 16'" is shown diagrammatically in FIGS. 17–24. This sterilization of canister 12 and subsequent transfer of object 20 to and from canister 12 is accomplished through a series of steps. To begin,canister 12 and first isolator 16' are sealed and sterilized as shown in FIGS. 17 and 18. Doors 30, 40 are positioned to lie in respective frames 56, 112 and sealed as shown in FIGS. 19A and 19B. Canister 12 is then uncoupled from first isolator 16' as shown in FIG. 20 and coupled to second isolator 16" containing object 20 as shown in FIG. 21. The transfer port apparatus 10 interconnecting canister 12 and second isolator 16" is opened by removing canister door 30 and isolator door 40 and object 20 is then moved from second isolator 16" into mobile canister 12 through an opened passageway in transfer port apparatus 10 as shown in FIG. 21. After positioning doors 30, 40 in respective frames 56, 112, canister 12 (now containing object 20) is then undocked from second isolator 16" as shown in FIG. 22 and moved to dock with third isolator 16'" as shown in FIG. 23. Object 20 is then transferred from mobile canister 12 into third isolator 16'". This transfer process is illustrated in FIG. 24. Objects can also be transferred from isolator to isolator by coupling the isolators directly to one another.

As shown in FIG. 17, in the beginning, canister 12 is not coupled to first isolator 16' and isolator door 40 is not coupled to canister door 30. Neither canister 12 nor first isolator 16' have been sterilized. Master valve 218 is in the closed position so that vacuum supply 214 has uninterrupted negative pressure access to slave supply line 260. Vacuum supply 214 through slave supply line 260 applies negative air pressure to control ports 267 of isolator slave valves 220, 222 and to control ports 269 of canister slave valves 224, 226 so that all slave valves 220, 222, 224, 226 are in their closed positions blocking flow of pressurized compressed air from positive pressure supply 212 to either canister seal member 72 or isolator seal member 120. Seal members 72, 120 are in an uninflated position and canister door frame 56 is thus ready to receive canister door 30 therein and isolator door frame 112 is ready to receive isolator door 40 therein. Pressure selector valve 216 is in the negative pressure position capping off pressure supply branch 250.

Because canister 12 and first isolator 16' are exposed to the atmosphere, potential contaminates (not shown) could have entered canister 12 and first isolator 16' and spoiled the clean environment therein. Therefore, canister 12 and first isolator 16' must be sterilized with a hydrogen peroxide mist or other suitable sterilization process. To sterilize canister 12 and first isolator 16', canister 12 is coupled to first isolator 16' and a latch 57 is placed in a locked position to secure and seal canister door frame 56 to isolator door frame 112 as shown in FIG. 18. While in the locked position, canister 12 and first isolator 16' maintain a substantially air-tight seal therebetween. Isolator door 40 is also coupled to canister door 30 maintaining a substantially air-tight seal therebetween. Next, canister chamber 14 of canister 12 and isolation chamber 18 of first isolator 16' and exposed surfaces of coupled canister and isolator doors 30, 40 and transfer port apparatus 10 are exposed to the hydrogen peroxide mist (not shown) or other suitable sterilizing process.

Having just sterilized canister 12, first isolator 16', and exposed surfaces of canister and isolator doors 30, 40 and transfer port apparatus 10, it is then possible to disengage canister 12 from first isolator 16' and move canister 12 to engage second isolator 16" to enable a worker to transfer object 20 from second isolator 16" into movable canister 12 for transport to third isolator 16'" (or, for that matter, to first isolator 16'). To "undock" canister 12 from isolator 16, pneumatic system 210 is operated to inflate canister seal member 72 and isolator seal member 120 to "hold" canister and isolator doors 30, 40 in pressure-locked retained positions in respective canister and isolator door frames 56, 112 and canister door frame 56 is unlatched and then disengaged from isolator door frame 112. To "dock" canister 12 to isolator 16, canister door frame 56 is mated and latched to isolator door frame 112 to establish transfer port apparatus 10 between canister 12 and isolator 16 and then pneumatic system 210 is operated to deflate canister seal member 72 and isolator seal member 120 to "release" canister and isolator doors 30, 40 from "pressure-locked" retained positions in canister and isolator door frames 56, 112.

To retain canister and isolator doors 30, 40 in door frames 56, 112, seal members 72, 120 are inflated using compressed air and moved to the inflated positions as shown in FIG. 19A. In order to move seal members 72, 120 to their inflated positions, circuit 232 is operated to move master valve 218 to an opened position conducting compressed air at a positive pressure from positive pressure supply 212 to control ports 267 of isolator slave valves 220, 222 and control ports 269 of canister slave valves 224, 226 through slave supply line 260. This positive pressure at control ports 267, 269 moves all four slave valves 220, 222, 224, 226 from their closed positions shown in FIG. 18 to their opened positions shown in FIG. 19A.

At approximately the same time as slave valves 220, 222, 224, 226 are being opened, circuit 232 operates to move pressure selector valve 216 from its negative pressure position shown in FIG. 18 to its positive pressure position shown in FIG. 19A to conduct compressed air from positive pressure supply 212 (1) along a first path to inlet port 290 of first isolator slave valve 220 through main branch 282, junction 286, and isolator branch 288 and on to inlet port 310 of second isolator slave valve 222 through line 312 into isolator seal supply line 320 and (2) along a second path through main branch 282, junction 286, and canister branch 292 to inlet port 294 of first canister slave valve 224 and on to inlet port 316 of second canister slave valve 226 through line 318 into canister seal supply line 324. The compressed air moving in isolator seal supply line 320 reaches and inflates isolator seal member 120 while the compressed air moving in canister seal supply line 324 reaches and inflates canister seal member 72 as shown in FIG. 19A.

After a short predetermined time delay set by a timer included in circuit 232, master valve 218 is moved to its closed position causing all four slave valves 220, 222, 224, 226 to be exposed to vacuum at control ports 267, 269 and then moved to their closed positions by the vacuum as shown in FIG. 19B The pressurized air applied to canister seal member 72 is "locked" in canister seal supply line 324 by closed canister slave valves 224, 226. The pressurized air applied to isolator seal member 120 is locked in isolator supply line 320 by closed isolator slave valves 220, 222. After the pressurized air is locked in canister seal supply line 324 and in isolator supply line 320, pressure selector valve 216 optionally moves to is negative pressure setting.

Having inflated seal members 72 and 120, latch 57 is moved from a locked position to an unlocked position to enable a worker to move canister 12 away from first isolator 16' as shown in FIG. 20. Isolation chamber 18 in first isolator 16' and canister chamber 14 in canister 12 remain unspoiled because seal members 72, 120 are still expanded by positive pressure in respective canister and isolator seal supply lines 324, 320 so that doors 30, 40 are in the retained and sealed positions in door frames 56, 112 and maintain a substantial seal between the environment and respective interior chambers 14, 18.

Because canister 12 is separated from first isolator 16', it can be docked to another isolator 16" as shown in FIG. 21. To couple canister 12 to second isolator 16", canister door frame 56 of canister 12 and isolator door frame 112 of second isolator 16" must be aligned so that hollow pin 272 in pneumatic junction 270 aligns with and fits into pin-receiving aperture 276 in canister door frame 56 and a hollow pin 295 in pneumatic junction 296 aligns with and fits into a pin-receiving aperture 297 in canister door frame 56.

Having aligned canister 12 with second isolator 16", canister 12 is then coupled to second isolator 16" as shown in FIG. 21. This coupling secures isolator door 40 to canister door 30 using plurality of latch members 148 as previously discussed. Latch 57 is also moved from the unlocked position to the locked position.

Having locked and sealed canister 12 onto second isolator 16", seal members 72, 120 are deflated and are retracted from grooves 91, 139 so that isolator and canister doors 40, 30 are no longer retained in door frames 112, 56 as shown in FIG. 21. Seal members 72, 120 are retracted from grooves 91, 139 by negative pressure supplied by vacuum supply 214 via respective canister seal supply line 324 and isolator seal supply line 320. In order to move seal members 72, 120 to the deflated positions, circuit 232 is operated to move master valve 218 to an opened position providing positive pressure from positive pressure supply 212 to control ports 267, 269 of respective slave valves 220, 222, 224, 226 through slave supply line 260. This positive pressure at control ports 267, 269 moves slave valves 220, 222, 224, 226 from the closed positions shown in FIG. 20 to the opened positions as shown, for example, in FIG. 21.

At approximately the same time a slave valves 220, 222, 224, 226 are being opened, circuit 232 moves pressure selector valve 216 to its negative pressure position as shown in FIG. 21 providing negative pressure from vacuum supply 214 to inlet port 290 of first isolator slave valve 220 and to inlet port 294 of first canister slave valve 224. Because first slave valves 220, 224 are in the opened position as mentioned above, negative pressure draws air from control lines 320, 324 coupled to seal members 120, 72 through second slave valves 222, 226 to first slave valves 220, 224. Likewise, because first slave valves 220, 224 are in the opened position as mentioned above, negative pressure draws air through first slave valves 220, 224 to vacuum supply 214 and an exhaust 215. The withdrawal of air from control lines 320, 324 retracts seal members 72, 120 to their deflated positions as shown in FIG. 21.

Because latch 57 remains in the locked position, canister 12 remains substantially sealed to second isolator 16" even though seal members 72, 120 are deflated. Next, isolator door 40 and canister door 30 are removed into isolation chamber 18" of second isolator 16" so that object 20 can be placed within canister chamber 14 of canister 12 as shown in FIG. 21.

As shown in FIG. 20, certain exterior portions of mounted isolator door 40 and mounted canister door 30 will be exposed to the atmosphere upon separation of canister 12 from first isolator 16'. However, as shown best in FIG. 3A, these portions will be isolated together inside the annular seal established by mating engagement of seal 99 on canister door frame 56 and perimeter rim 143 on isolator door frame 112 upon coupling of canister and isolator doors as shown in FIG. 21 to block contamination of second isolator 16" upon movement of doors 30, 40 from transfer port apparatus 10 into isolation chamber 18" of second isolator 16".

After object 20 is transferred from second isolator 16" into canister 12, doors 30, 40 are positive to lie within respective frames 56, 112, seal members 72, 120 are reinflated, and canister 12 is separated from second isolator 16" as shown in FIG. 22. Canister 12 can then be docked to a third isolator 16'" (or any other isolator) as shown in FIG. 23 and, after seal members 72, 120 are deflated and doors 30, 40 are removed, object 20 can be transferred through transfer port apparatus 10 into an isolation chamber 18'" in third isolator 16'".

Figure 26:
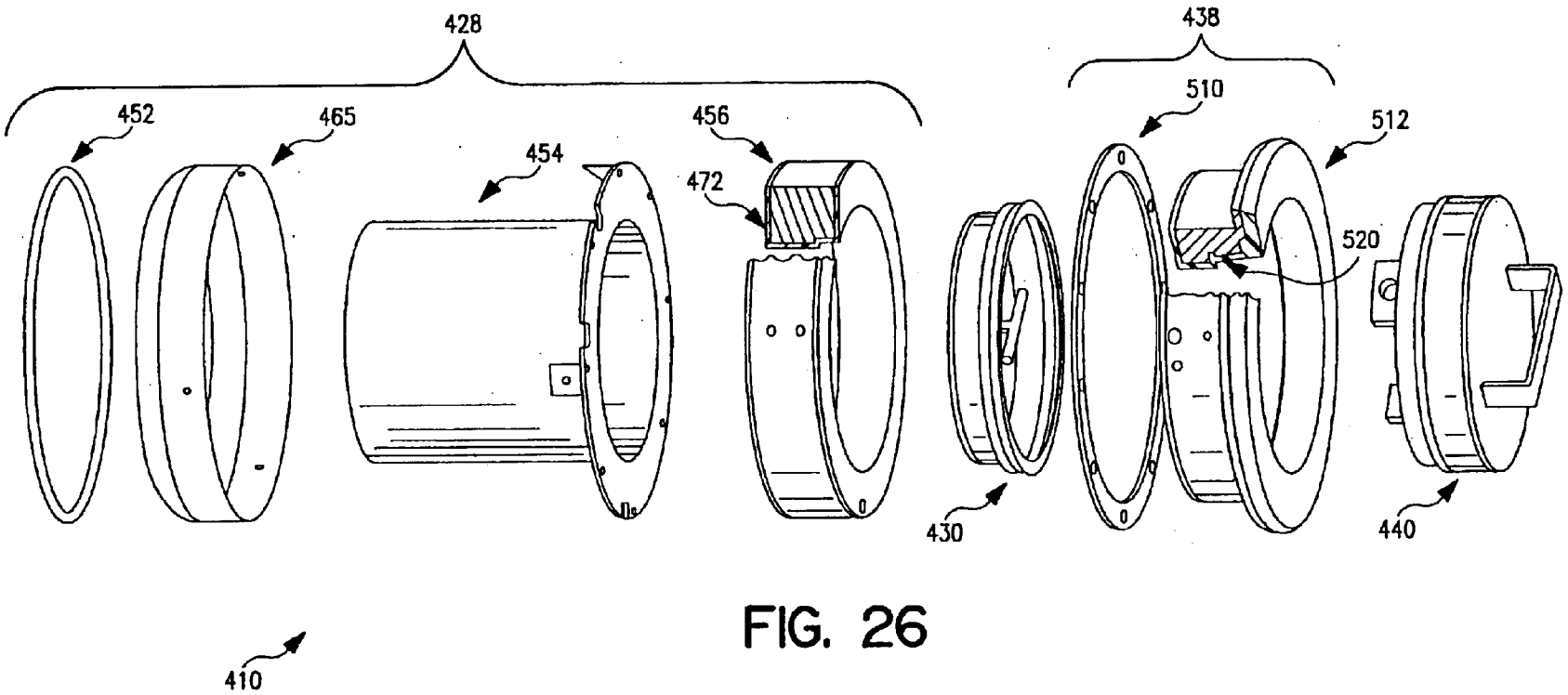
FIG. 26 is a perspective assembly view of components in an alternative transfer port apparatus in accordance with the present invention.
Figure 27A:
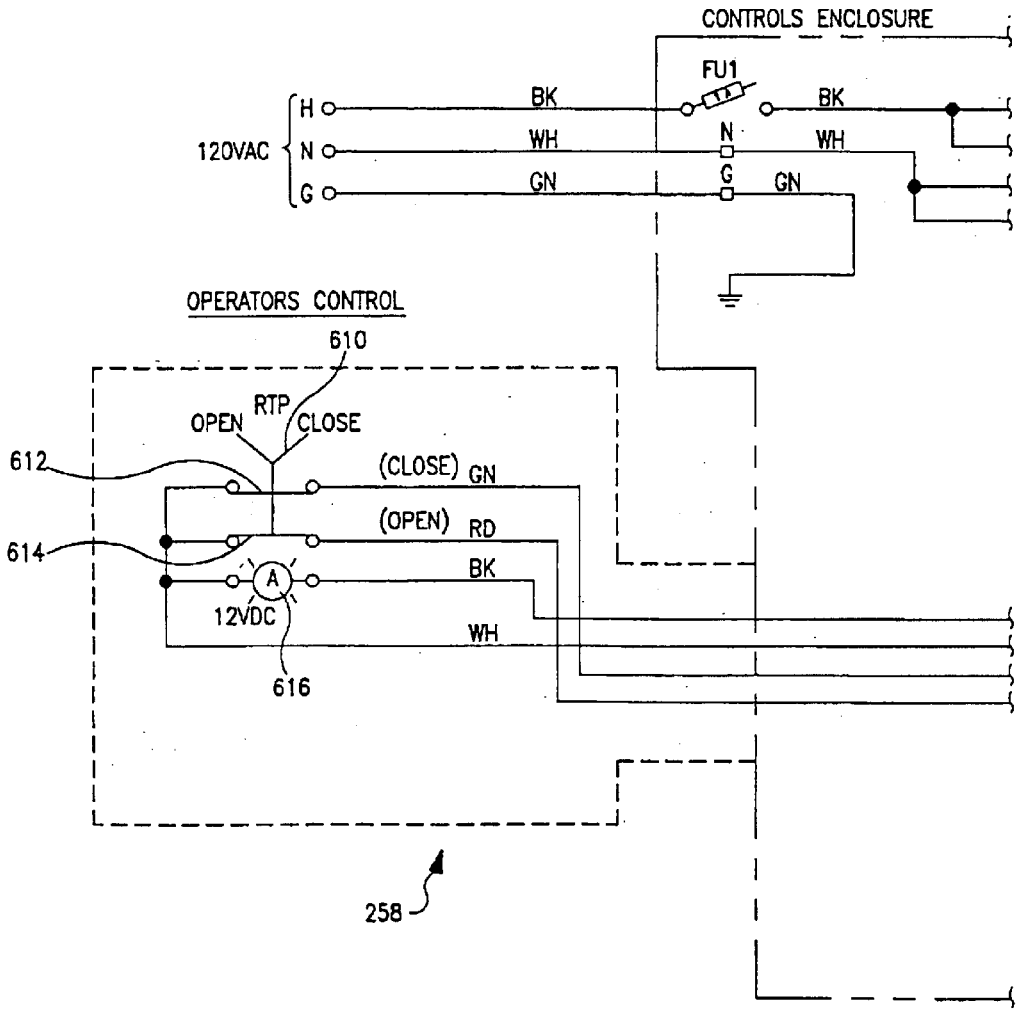
FIG. 27 is a block diagram showing a control circuit for use in the rapid transfer port of FIG. 17, a proximity sensor wired to the control circuit and a control panel wired to the control circuit.
Figure 27B:
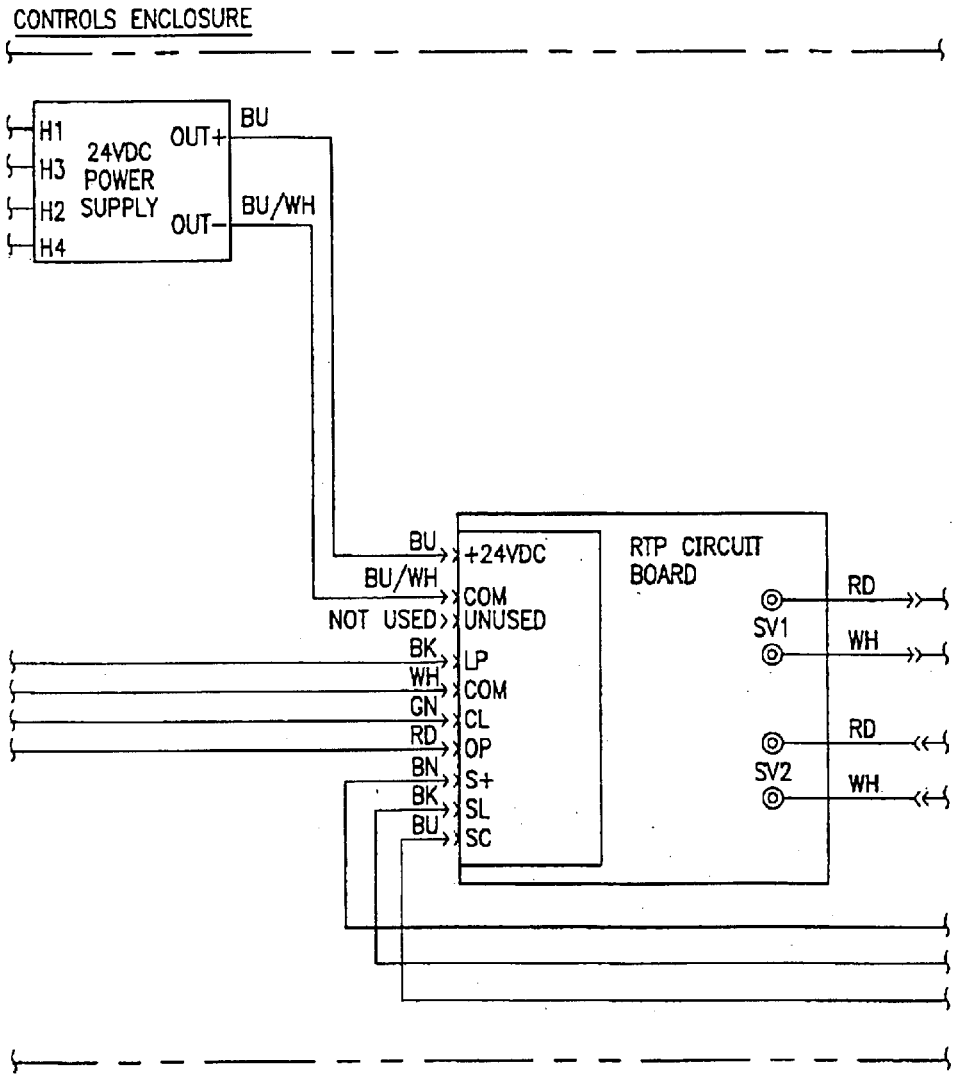
Figure 27C:
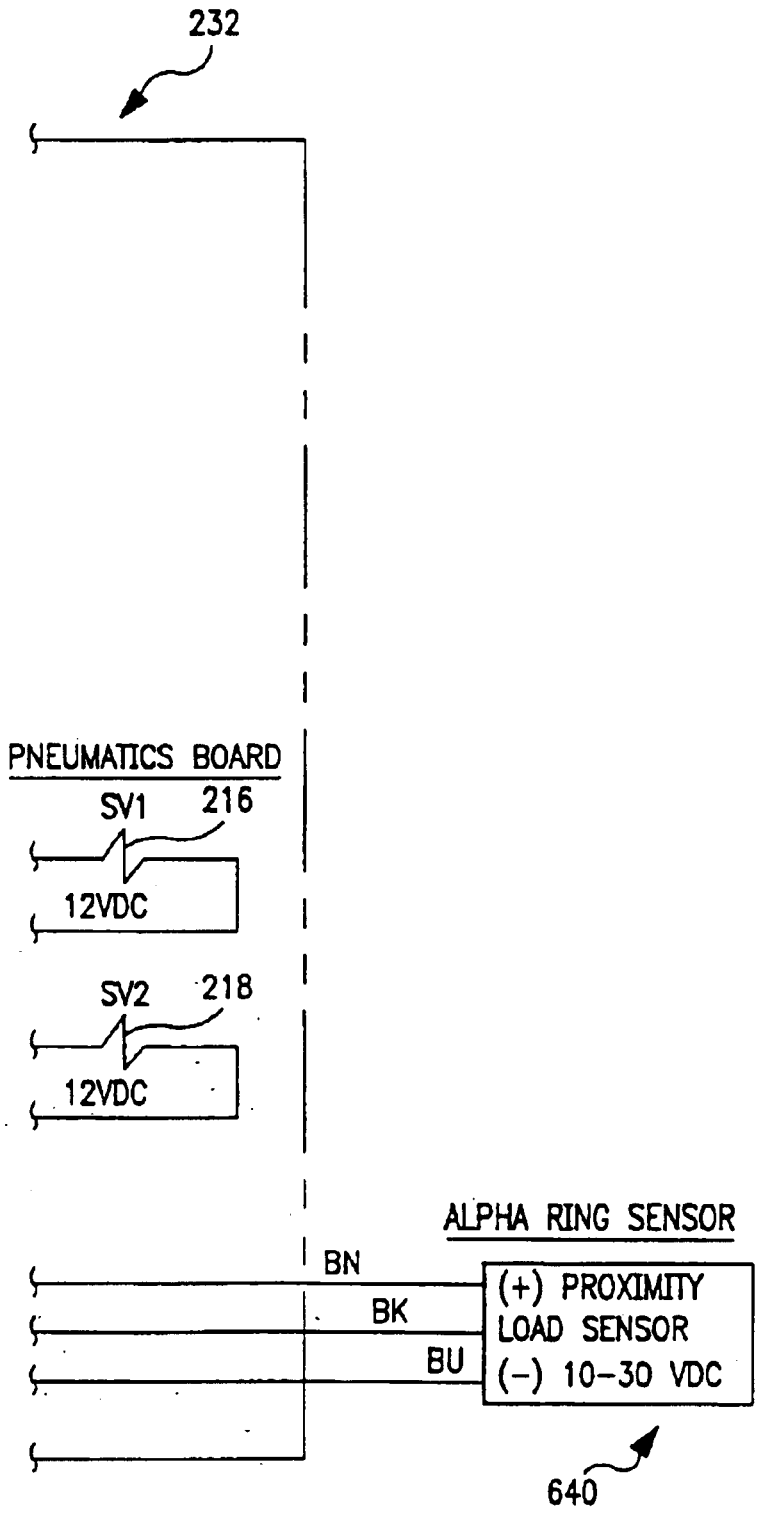
Figure 28A:
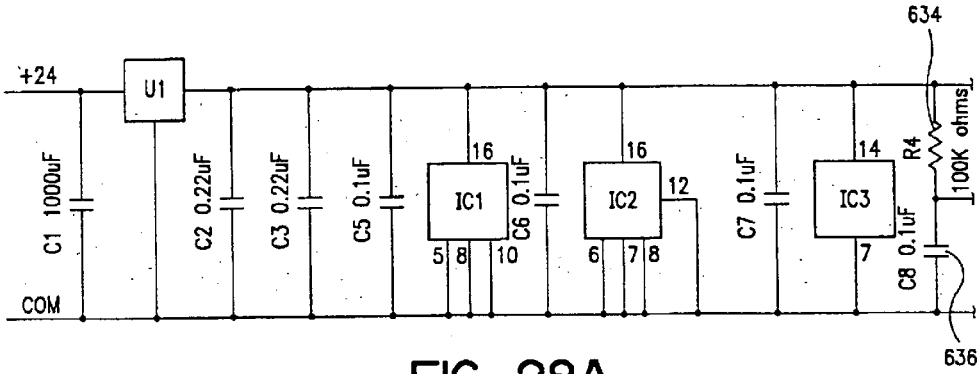
FIGS. 28–31 cooperate to show a schematic of the control circuit of FIG. 27.
Figure 28B:
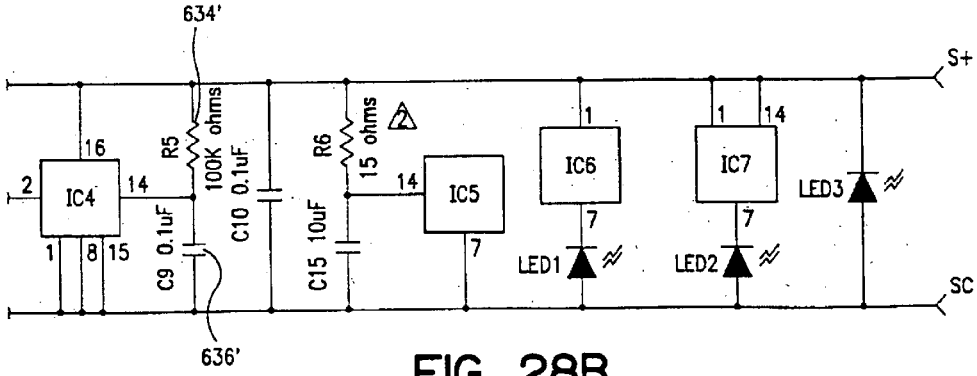

An alternative embodiment of transfer port apparatus 10 is shown in a FIG. 26. Apparatus 410 is very similar to apparatus 10 and includes a canister portion 428, an isolator portion 438, a canister door 430, and an isolator door 440. Canister portion 428 includes a gasket 452, a mounting fixture 454, a shroud 465, and a canister door frame 456. Isolator portion 438 includes a gasket 510 and isolator door frame 512. An inflatable seal 472 is mounted on canister door frame 456 and an inflatable seal 520 is mounted on isolator door frame 512.

In a preferred embodiment, when a user actuates circuit 232 to "deflate" or contract seal members 72, 120, circuit 232 moves master valve 218 to the open position so that positive pressure is supplied through slave supply line 260 to control ports 267 of isolator slave valves 220, 222 and to control ports 269 of canister slave valves 224, 226 so that all slave valves 220, 222, 224, 226 are in their open positions allowing flow of air away from canister seal member 72 and isolator seal member 120. At approximately the same time, circuit 232 moves pressure selector valve 216 to its negative pressure position providing negative pressure from vacuum supply 214 to inlet port 290 of first isolator slave valve 220 and to inlet port 294 of first canister slave valve 224. Because first slave valves 220, 224 are in the opened position as mentioned above, negative pressure draws air from control lines 320, 324 coupled to seal members 120, 72 through second slave valves 222, 226 to first slave valves 220, 224. Further, because first slave valves 220, 224 are also in the opened position as mentioned above, negative pressure draws air through first slave valves 220, 224 to vacuum supply 214 and an exhaust 215. The withdrawal of air from control lines 320, 324 retracts seal members 72, 120 to their deflated positions.

Figure 29A:
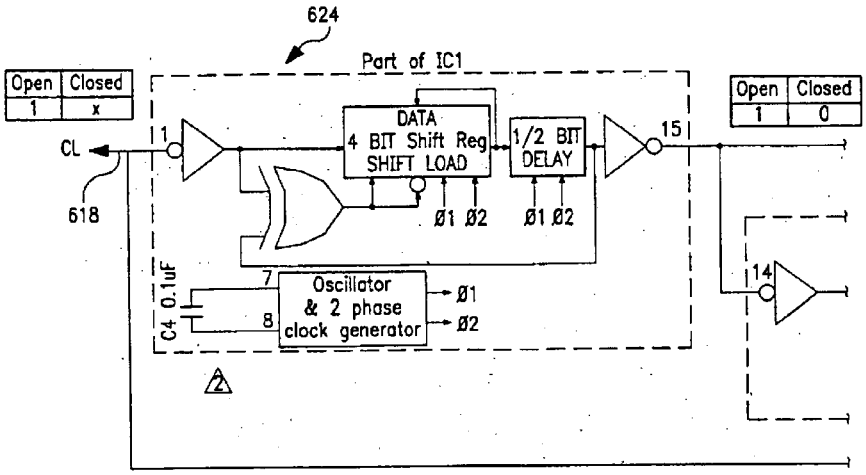
Figure 29B:
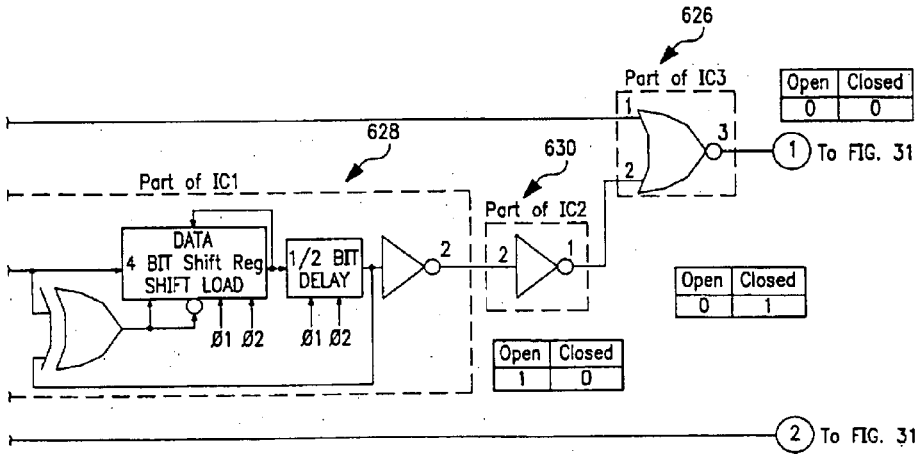
Figure 30A:
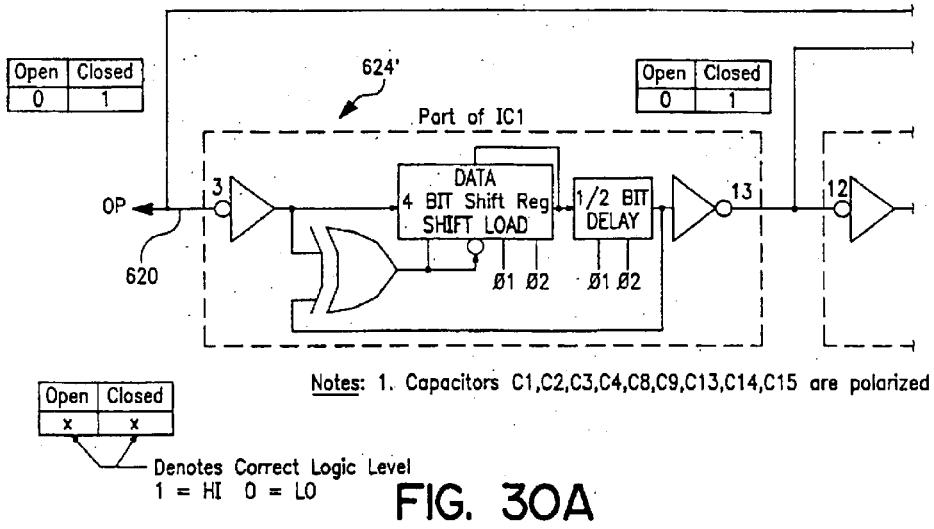
Figure 30B:
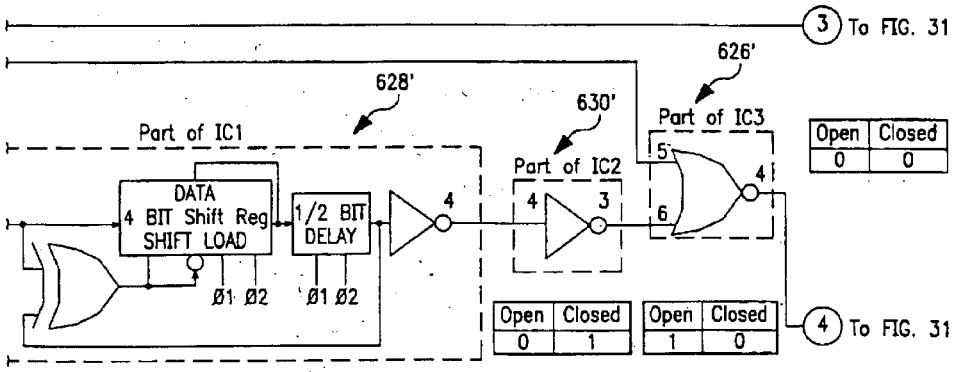

Electrical circuit 232 is used to control master valve 218 and pressure selector valve 216 based on-user input from control panel 258. Control panel 258 includes a switch 610 and an in-process lamp 616 to indicate the current status of the apparatus. Control panel 258 has two normally-high outputs, CL 618 (FIG. 29) and OP 620 (FIG. 30). Selecting the "open" position 614 of switch 610 grounds OP 620, and selecting the "close" position 612 grounds CL 618.

Figure 31A:
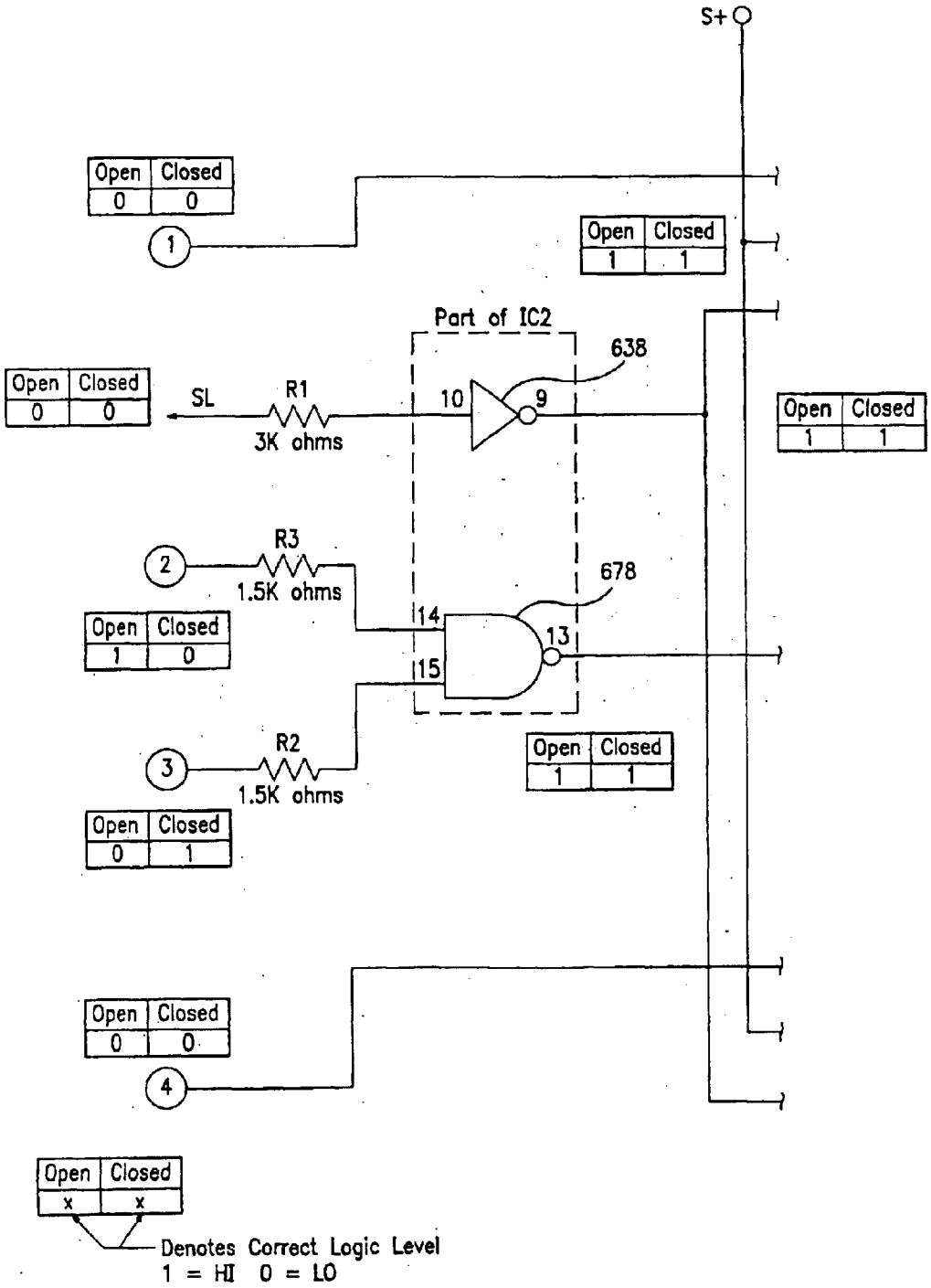
Figure 31B:
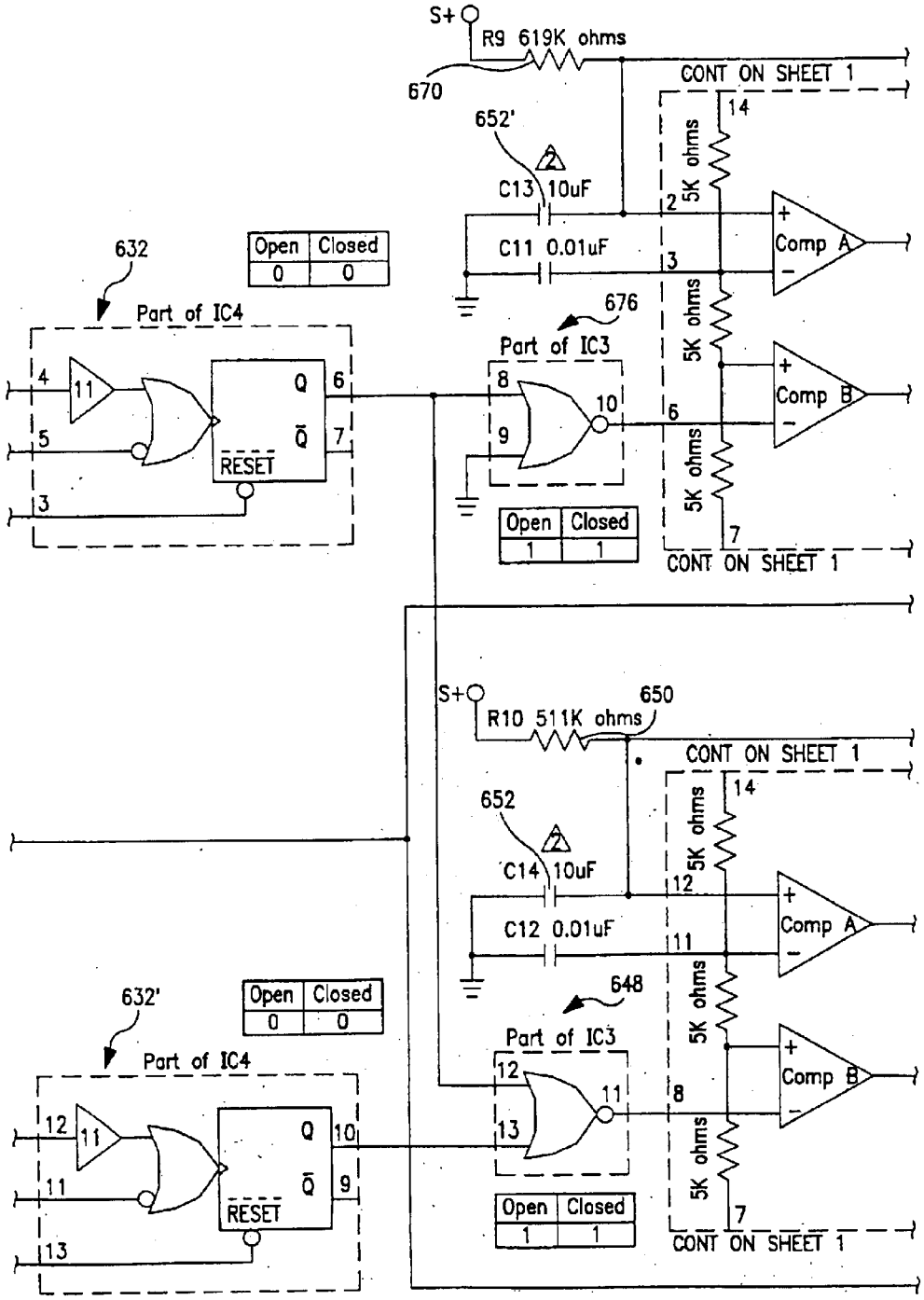
Figure 31C:
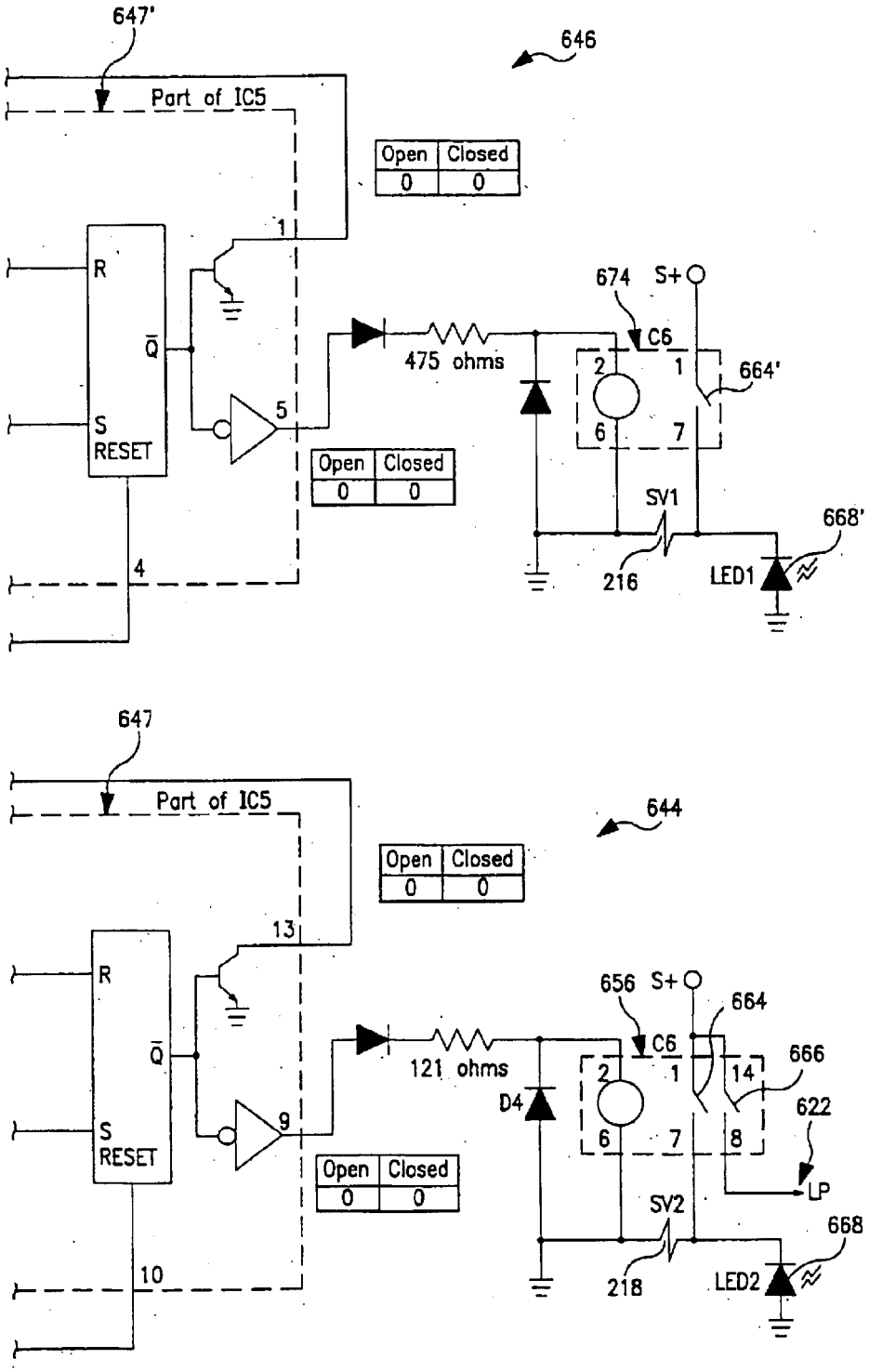

The selecting of inputs CL 618 and OP 620 is similar. Consequently, a description of the processing of CL 628 should suffice for an understanding of the processing of OP 620 as well. FIGS. 29, 30 and 31 utilize similar numbers to denote similar circuits on the two signal paths, with the distinction that the circuit components which process the OP signal at 620 are designated by a prime (').  Once the CL signal at 618 is detected by circuit 232 it first passes through a debounce circuit 624 to clear any switch noise. The illustrated embodiment utilizes a Motorola type MC14490 hex contact bounce eliminator. The output signal from debounce circuit 624 is coupled to a delay circuit to provide a momentary "high" signal. This delay circuit is realized in the illustrated embodiment by supplying the output signal from debounce circuit 624 to a NOR gate 626, and to a delay buffer 628. In the illustrated embodiment, another section of the MC 14490 IC provides the delay buffer 628. The delayed signal is then inverted by an inverter 630. The output of the inverter 630 is coupled to an input of NOR gate 626. The signal from debounce circuit 624 initially forces NOR gate 626 to output a "high" signal. Once the inverted delayed signal reaches NOR gate 626, the output of NOR gate 626 turns off.

The signal from the NOR gate 626 is used to activate a trigger circuit 632, illustrated as a Motorola MC14538 monostable multivibrator configured to be a rising edge trigger. A 100K ohm resistor 634 and a .1 uF capacitor 636 are utilized to determine the correct trigger timing. Once trigger circuit 632 detects the signal from NOR gate 626, a "high" trigger signal is generated. The output of trigger circuit 632 is coupled to both pressure solenoid driver 646 and master solenoid driver 644 (jointly referred to as "drivers 646,644") inputs to allow the trigger signal to activate both drivers 646,644. A major difference between the CL 618 input path and the OP 620 input path is that the output of trigger circuit 632' for OP 620 is coupled only to an input of master solenoid driver 644.

Both drivers 646,644 are configured to emit a timed signal to control the pressure selector valve 216 and the master valve 218 respectively. In the illustrated embodiment each driver utilizes one half of a Motorola type MC3456 timing circuit 647. The MC3456 timer 647 has only one input pin per half (pins 6 and 8). These inputs are active-low. To allow trigger 632, 632' to properly activate the drivers 646,644 a NOR gate 648 is used to input signals from both triggers 632, 632' to MC3456 647'. A NOR gate 676 is used to invert the output from trigger 632 for input into MC3456 647. Master solenoid driver 644 is configured to emit a 7 second "high" signal. To select the correct timing for the signal, a 511 k ohm resistor 650 and a 10 uF capacitor 652 are coupled to pin 12 and between power and ground. Pressure solenoid driver 646 is configured to emit an 8 second "high" signal. To select the correct timing for the signal, a 619 k ohm resistor 670 and a 10 uF capacitor 652' are coupled to pin 2 and between power and ground. In the illustrated embodiment each driver 646, 644 uses a relay 674, 656 to provide switched power to valves 216 and 218. The relay is triggered into conduction by the "high" signal from MC3456, 647. LED 668, 668' is connected between the relay 674, 656 switched power output and ground. Relay 656 on master solenoid driver 644 also includes a second switched power output 666 to provide power to in-process lamp 616 while the master valve 218 is activated.

Both triggers 632,632' and drivers 644, 646 also have RESET terminals which can be activated to disable the possibility of a false signal being sent. Triggers 632, 632' have a RESET terminal connected to a proximity sensor 640. Proximity sensor 640 is configured to sense when canister portion 28 is connected to isolator portion 38. The output generated by proximity sensor 640 is "high" if the portions 28,38 are not connected, while the signal generated is "low" when the portions 28,38 are connected. In the illustrated embodiment the multivibrators of triggers 632, 632', have active-low RESET so the output of the proximity sensor must be inverted by inverter 638 whose output is then coupled to the RESET terminals of triggers 632,632'. This connection to the sensor ensures that the valves will be operated only when the two portions 28 and 38 are connected. The drivers 646, 644 have a RESET terminal configured to disable the circuit when neither of the switched positions are selected. In the illustrated embodiment CL input 618 and OP input 620 and coupled to the inputs of a NAND gate 678. The output of NAND gate 678 is coupled to the RESET terminals of MC3456 timer IC 647.

Although the invention has been described in detail with reference to certain preferred embodiments, variations and modifications exist within the scope and spirit of the invention as described and defined in the following claims.

What is claimed is:

1. A transfer port apparatus comprising a canister portion formed to include a canister passageway and adapted to be coupled to a canister to place the canister passageway in communication with a canister chamber formed in the canister, an isolator portion formed to include an isolator passageway and adapted to be coupled to an isolator to place the isolator passageway in communication with an isolation chamber formed in the isolator, a latch arranged to couple the canister portion to the isolator portion to place the canister passageway in communication with the isolator passageway to establish a transfer conduit through the canister and isolator portions, a removable conduit closure arranged to lie in and occlude the transfer conduit, the canister portion including a seal support and an expansible seal member mounted on the seal support and arranged to move relative to the seal support from a contracted position to an expanded position to establish a substantially airtight sealing engagement with the removable conduit closure, the expansible seal member including an inner ring configured to mate with and seal against the removable conduit closure upon insertion of the movable conduit closure into the canister passageway formed in the canister portion, and means for passing a pressurized fluid through the isolator portion and the seal support to a fluid-receiving space provided between the seal support and the inner ring to move the inner ring away from the seal support to the expanded position against the removable conduit closure, the passing means including a single air conduit formed in the seal support and the isolator portion.

2. The apparatus of claim 1, wherein the removable conduit closure includes a canister door sized to close the canister passageway, the inner ring is positioned to engage an outer surface of the canister door upon movement of the expansible seal member to the expanded position to establish a substantially airtight seal therebetween, the removable conduit closure further includes an isolator door sized to close the isolator passageway and arranged to lie adjacent to the canister door when the canister portion is coupled to the isolator portion, and further comprising means for retaining the pressurized fluid in the fluid-receiving space to maintain the inner ring in the expanded position engaging the outer surface of the canister door upon decoupling of the canister portion and isolator portion while the canister door is positioned to close the canister passageway and the isolator door is positioned to close the isolator passageway, the retaining means including a valve coupled to the air conduit formed in the seal support and configured to move between an opened position allowing flow of pressurized fluid into the air conduit to reach the inner ring and a closed position retaining pressurized fluid in the air conduit to maintain the inner ring in the expanded position.

3. The apparatus of claim 1, wherein the passing means further includes a pressurized fluid source and further comprising vacuum means for removing the pressurized fluid from the fluid-receiving space and applying a suction force to the inner ring in the fluid-receiving space to move the inner ring from the expanded position to the contracted position to disestablish the substantially airtight sealing engagement with the removable conduit closure, the vacuum means including a vacuum generator and a pressure selector coupled to the vacuum generator, the pressurized fluid source, and the air conduit and configured to move between a seal-establishing position coupling only the pressurized fluid source to the air conduit and a seal-disestablished position coupling only the vacuum generator to the air conduit.

4. The apparatus of claim 1, wherein the passing means further includes a pressurized fluid source, a distribution conduit coupled to the pressured fluid source, and a connector coupled to the distribution conduit and configured to be coupled to the air conduit upon coupling of the canister portion to the isolator portion to enable pressurized fluid to pass from the pressurized fluid source into the air conduit through the distribution conduit and the connector, and the isolator portion is formed to include a portion of the distribution conduit therein.

5. The apparatus of claim 1, wherein the passing means further includes a pressurized fluid source and a distribution conduit coupled to the pressurized fluid source and the air conduit includes a firs channel coupled to the distribution conduit and arranged to discharge pressurized fluid to a first portion of the inner ring and a second channel coupled to the distribution conduit and arranged to discharge pressurized fluid to a second portion of the inner ring.

6. The apparatus of claim 5, wherein the first portion of the inner ring is a first frustoconical section, the second portion of the inner ring is a second frustoconical section, and the inner ring further includes an annular ledge positioned to lie between and interconnect the first and second frustoconical sections.

7. The apparatus of claim 1, wherein the expansible seal member further includes a back ring and a front ring positioned to lie in axially spaced-apart relation to the back ring and abut the isolator portion upon coupling of the canister portion to the isolator portion and the inner ring interconnects inner edges of the back and front rings and the seal support contacts the back, front, and inner rings.

8. The apparatus of claim 7, wherein the inner ring includes a first frustoconical section appended to the back ring, a second frustoconical section appended to the front ring, and an annular ledge positioned to lie between and interconnect the first and second frustoconical sections.

9. The apparatus of claim 7, wherein the seal support is formed to include an air conduit arranged to conduct pressurized fluid to a fluid-receiving space provided between the seal support and the inner ring and the inner ring is configured to flex and move relative to the back and front rings upon admission of pressurized fluid into the fluid-receiving space.

10. The apparatus of claim 7, wherein the inner ring includes a first frustoconical section appended to the back ring, a second frustoconical section appended to the front ring, and an annular ledge positioned to lie between and interconnect the first and second frustoconical sections, the seal support is formed to include an air conduit arranged to conduct pressurized fluid to a fluid-receiving space provided between the seal support and the inner ring and the inner ring is configured to flex and move relative to the back and front rings upon admission of pressurized fluid into the fluid-receiving space, and further comprising a pressurized fluid source and a distribution conduit coupled to the pressurized fluid source, the air conduit including a first channel coupled to the distribution conduit and arranged to apply pressurized fluid to the first frustoconical section of the inner ring and a second channel coupled to the distribution conduit and arranged to apply pressurized fluid to the second frustoconical section of the inner ring.

11. The apparatus of claim 10, wherein the isolator portion is formed to include a portion of the distribution conduit.

12. The apparatus of claim 1, wherein the canister portion further includes a mounting fixture formed to include a central opening and arranged to lie in spaced-apart relation to the seal support of the isolator portion to position the seal support of the canister portion therebetween to cause the central opening formed in the mounting fixture to cooperate with the canister and isolator passageways to define the transfer conduit.

13. The apparatus of claim 12, wherein the expansible seal member includes an inner ring configured to mate with and seal against the removable conduit closure upon insertion of the movable conduit closure into the canister passageway formed in the canister portion, the expansible seal member further includes a back ring and a front ring positioned to lie in axially spaced-apart relation to the back ring and abut the isolator portion upon coupling of the canister portion to the isolator portion and the inner ring interconnects inner edges of the back and front rings and the seal support contacts the back, front, and inner rings, and the back ring is arranged to abut the mount fixture.

14. The apparatus of claim 1, wherein the removable conduit closure includes a canister door sized to close the canister passageway and an isolator door sized to close the isolator passageway and further comprising first fluid delivery means for passing a pressurized fluid through the seal support to reach the expansible seal member and move the expansible seal member to the expanded position against the canister door, the first fluid delivery means including a canister air conduit formed in the seal support.

15. The apparatus of claim 14, wherein the isolator portion includes an isolator door frame formed to include the isolator passageway and arranged to engage the isolator door upon insertion of the isolator door into the isolator passageway and further comprising a pressurized fluid source and means for conducting pressurized fluid from the pressurized fluid source to the canister air conduit, the conducting means including a distribution conduit and a portion of the distribution conduit being coupled to the isolator door frame.

16. The apparatus of claim 15, wherein the conducting means further includes a connector coupled to the portion of the distribution conduit that is coupled to the isolator door frame and configured to be coupled to the canister air conduit upon-coupling of the canister portion to the isolator portion to enable pressurized fluid to pass from the distribution conduit into the canister air conduit through the connector.

17. The apparatus of claim 14, farther comprising a vacuum generator, means for applying a vacuum created by the vacuum generator to the canister air conduit, the applying means including a distribution conduit, and a pressure selector coupled to the vacuum generator, the pressured fluid source, and the distribution conduit, the pressure selector being configured to move between a seal-establishing position coupling only the pressurized fluid source to the distribution conduit to conduct pressurized fluid through the distribution conduit and the canister air conduit to the expansible seal member and a seal-disestablishing position coupling only the vacuum generator to the distribution conduit to apply a vacuum suction force to the expansible seal member via the distribution channel and the air conduit.

18. The apparatus of claim 17, wherein the isolator portion includes an isolator door frame formed to include the isolator passageway and arranged to engage the isolator door upon insertion of the isolator door into the isolator passageway and a portion of the distribution conduit is coupled to the isolator door frame.

19. The apparatus of claim 18, wherein the applying means further includes a connector coupled to the portion of the distribution conduit that is coupled to the isolator door frame and configured to be coupled to the canister air conduit upon coupling of the canister portion to the isolator portion to enable a vacuum to be applied to the expansible seal member via the distribution conduit, the connector, and the canister air conduit.

20. The apparatus of claim 17, wherein the isolator portion includes a second seal support and a second expansible seal member mounted on the second seal support and arranged to move relative to the second seal support from a contracted position to an expanded position to establish a substantially airtight scaling engagement with the isolator door, and further comprising second fluid delivery means for passing a pressurized fluid through the second seal support to reach the second expansible seal member and move the second expansible seal member to the expanded position against the isolator door, the second fluid delivery means including an isolator air conduit formed in the second seal support.

21. The apparatus of claim 20, further comprising a pressurized fluid source and means for conducting pressurized fluid from the pressurized fluid source to the canister air conduit and the isolator air conduit, the conducting means including a first branch distribution conduit configured to conduct pressurized fluid to the canister air conduit to move the expansible seal member of the canister portion to the expanded position against the canister door and a second branch distribution conduit configured to conduct pressurized fluid to the isolator air conduit to move the second expansible seal member of the isolator portion to the expanded position against the isolator door.

22. The apparatus of claim 20, further comprising a vacuum generator, means for applying a vacuum created by the vacuum generator to the canister air conduit and the isolator air conduit, the applying means including a first branch distribution conduit configured to communicate a vacuum to the canister air conduit so as to apply a vacuum suction force to the expansible seal member of the canister portion and a second branch distribution conduit configured to communicate a vacuum to the isolator air conduit so as to apply a vacuum suction force to the second expansible seal member of the isolator portion.

23. The apparatus of claim 20, further comprising means for retaining pressurize fluid in the canister air conduit to maintain the expansible seal member of the canister portion in the ended position engaging the canister door upon decoupling of the canister portion and isolator portion while the canister door is positioned to close the canister passageway and the isolator door is positioned to close the isolator passageway, the retaining means including a canister lave valve coupled to the canister air conduit formed in the seal support of the canister and configured to move between an opened position allowing flow of pressurized fluid into the canister air conduit to reach the expansible seal member of the canister and a closed position retaining pressurized fluid in the canister air conduit to maintain the expansible seal member of the canister in the expanded position.

24. The apparatus of claim 20, further comprising means for retaining pressurized fluid in the canister air conduit and in the isolator air conduit to maintain the expansible seal of the canister portion in the expanded position engaging the canister door and to maintain the second expansible seal in the expanded position engaging the isolator door upon decoupling of the canister portion and the isolator portion while the canister door is positioned to close the canister passageway and the isolator door is positioned to close the isolator passageway, the retaining means including a canister slave valve coupled to the canister air conduit formed in the seal support of the canister and configured to move between an opened position allowing flow of pressurized fluid into the canister air conduit to reach the expansible seal member of the canister and a closed position retaining pressurized fluid in the canister air conduit to maintain the expansible seal member of the canister in the expanded position, and an isolator slave valve coupled to the isolator air conduit formed in the second seal sort and configured to move between an opened position allowing flow of pressurized fluid into the isolator air conduit to reach the second expansible seal member and a closed position retaining pressurized fluid in the isolator air conduit to maintain the second expansible seal member in the expanded position.

25. The apparatus of claim 24, further comprising a pressurized fluid source, a connector configured to be coupled to the canister air conduit upon coupling of the canister portion to the isolator portion to enable pressurized fluid in the connector to pass into the canister air conduit, a distribution conduit coupled to the pressurized fluid source and coupled to the connector to transmit pressurized fluid to the canister air conduit and to the isolator air conduit and wherein the isolator portion is formed to include a portion of the distribution conduit therein.

26. A transfer port apparatus comprising a canister portion formed to include a canister passageway and adapted to be coupled to a canister to place the canister passageway in communication with a canister chamber formed in the canister, an isolator portion formed to include an isolator passageway and adapted to be coupled to an isolator to place the isolator passageway in communication with an isolation chamber formed in the isolator, and coupled to the canister portion to define a transfer conduit extending therebetween, a removable conduit closure movable to a position in the transfer conduit to occlude the transfer conduit, and pneumatic means for selectively inflating and deflating expansible seal members included in the canister and isolator portions using pressurized fluid and vacuum suction forces passing through the isolator portion to move the seal members to establish airtight sealing engagement with the removable conduit closure.

27. The apparatus of claim 26, wherein the canister portion includes a canister door frame adapted to be coupled to an opening formed in a canister having a canister chamber therein and the canister door frame includes a seal support and a first of the expansible seal members and the first of the expansible seal members is coupled to the pneumatic means.

28. The apparatus of claim 27, wherein the isolator portion includes an isolator door frame adapted to be coupled to an opening formed in an isolator having an isolation chamber therein and the isolator door same includes a seal support and a second of the expansible seal members and the second of the expansible seal members is coupled to the pneumatic means.

29. The apparatus of claim 28, wherein the pneumatic means includes a distribution conduit having a first branch passing through the seal supports of the canister and isolator portions to communicate pressurized fluid and vacuum suction forces to the expansible seal member of the canister portion and a second branch passing through the seal support of the isolator portion to communicate pressurized fluid and vacuum suction forces to the expansible seal member of the isolator portion.

30. The apparatus of claim 27, wherein the pneumatic means includes an air conduit arranged to communicate pressurized fluid and vacuum suction forces to the expansible seal member and means for selectively retaining pressurized fluid in the air conduit to maintain the expansible seal member in airtight sealing engagement with a canister door included in the removable conduit closure upon decoupling of the canister portion from the isolator portion, the retaining means including a slave valve movable to open and close the air conduit.

31. The apparatus of claim 26, wherein the canister portion includes a canister door frame formed to include a portion of the transfer conduit and adapted to be coupled to an opening formed in a canister having a canister chamber therein, the isolator portion includes an isolator door frame formed to include another portion of the transfer conduit and adapted to be coupled to an opening formed in an isolator having an isolation chamber therein, and the removable conduit closure includes a canister door coupled to the canister frame and an isolator door coupled to the isolator frame and selectively coupled to the canister door to move therewith during removal of the removable conduit closure from the transfer conduit.

32. The apparatus of claim 31, wherein a rim on the canister door has an inner surface formed to include a groove sized to engage a spring-loaded ball detent latch member mounted on an underside of the isolator door to couple the isolator door to the canister door.

33. An apparatus comprising an isolator unit including an isolator shell configured to define an interior isolation chamber and formed to include an isolator chamber opening allowing access to the isolation chamber from a region exterior to the isolator unit, an isolator door frame coupled to the isolator shell and positioned to lie in the isolator chamber opening, the isolator door frame including an isolator seal support and an expandable isolator seal member, and an isolator door configured to mount to the isolator door frame and arranged to engage the isolator seal member and occlude an opening in the isolator door frame when in a closed position and to dingo the isolator seal member and allow access into the isolation chamber through the opening in the isolator door frame when the isolator door is an opened position, a mobile canister unit including a shell configured to define an interior canister chamber and formed to include a canister chamber opening allowing access to the canister chamber from a region exterior to the canister unit, a canister door frame coupled to the canister shell and positioned to lie in the canister chamber opening, the canister door frame including a canister seal support and an expandable canister seal member, and a canister door arranged to engage the canister seal member and occlude an opening in the canister door frame when in a closed position and to disengage the canister seal member and allow access into the canister chamber through the opening in the canister door frame when the canister door is in an opened position, a seal expander configured to urge prized fluid passing through the isolator unit against a surface of the canister seal member and a surface of the isolator seal member to move the canister seal member and the isolator seal member to the expanded position forming a first substantially airtight engagement between the canister seal member and the canister door and a second substantially airtight engagement between the isolator seal member and the isolator door.

34. The apparatus of claim 33, wherein the canister door frame is removably connected to the isolator door frame and the opening in the canister door frame is arranged to communicate with the opening in the isolator door frame when both the canister door and isolator door are in the opened position.

35. The apparatus of claim 33, wherein the isolator door is coupled to the canister door when both the isolator door and the canister door are in the closed position.

36. The apparatus of claim 33, further comprising a vacuum generator configured to remove pressures fluid from a surface of the canister seal member and from a surface of the isolator seal member to move the canister seal member and the isolator seal member to the contracted position and disengage the first and second substantially airtight engagements.

37. An apparatus comprising an isolator unit including an isolator shell configured to define an interior isolation chamber and formed to include an isolator chamber opening allowing access to the isolation chamber from a region exterior to the isolator unit, an isolator door frame coupled to the isolator shell and positioned to lie in the isolator chamber opening, the isolator door frame including an isolator seal support and an expandable isolator seal member, and an isolator door configured to mount to the isolator door frame and arranged to engage the isolator seal member and occlude an opening in the isolator door frame when in a closed position and to disengage the isolator seal member and allow access into the isolation chamber through the opening in the isolator door frame when the isolator door is in an opened position, a mobile canister unit including a shell configured to define an interior canister chamber and formed to include a canister chamber opening allowing access to the canister chamber from a region exterior to the canister unit, a canister door frame coupled to the canister shell and positioned to lie in the canister chamber opening, the canister door frame including a canister seal support and an expandable canister seal member, and a canister door arranged to engage the canister seal member and occlude an opening in the canister door frame when in a closed position and to disengage the canister seal member and allow access into the canister chamber through the opening in the canister door frame when the canister door is in an opened position, a seal expander system including an electronic control device configured to allow pressurized fluid to flow from a pressurized fluid supply when the electronic control device is activated, an isolator conduit configured to receive pressurized fluid flow from the pressurized fluid supply when the electronic control device is activated and configured to lie in fluid communication with a fluid junction located in the isolator unit and in fluid communication with a surface of the expandable isolator seal member, and a canister conduit in fluid communication with the fluid junction and with a surface of the expandable canister seal member.

38. The apparatus of claim 37, further comprising an isolator slave valve coupled to the isolator conduit and configured to move between an opened position allowing flow of pressurized fluid to or from the surface of the isolator seal member and a closed position prohibiting flow of pressurized fluid to or from the surface of the isolator seal member, and a canister slave valve coupled to the canister conduit and configured to move between an opened position allowing flow of pressurized fluid to or from the surface of the canister seal member and a closed position prohibiting flow of pressurized fluid to or from the surface of the canister seal member.

39. The apparatus of claim 37, wherein at least a portion of the isolator conduit passes through the isolator seal support.

40. The apparatus of claim 39, wherein the canister door frame is removably connected to the isolator door fry and the opening in the canister door frame is arranged to communicate with the opening in the isolator door frame when both the canister door and isolator door are in the opened position.

41. The apparatus of claim 39, wherein the fluid junction remains in fluid communication with the isolator conduit but not in fluid communication with the canister conduit when the mobile canister unit is moved and the removable connection between the canister door frame and the isolator door frame is removed.

42. The apparatus of claim 39, further comprising a vacuum generator in fluid communication with the isolator conduit and configured to apply negative fluid pressure to the surface of the isolator seal member and to the surface of the canister seal member.

43. The apparatus of claim 42, further comprising a pressure selector valve in electronic communication with the electronic control device and configured to move between a first position allowing flow of pressurized fluid from the pressurized fluid supply into the isolator conduit and a second position allowing negative pressure from the vacuum generator to remove pressurized fluid from the isolator conduit.

44. An apparatus comprising an isolator unit including an isolator shell configured to define an interior isolation chamber and formed to include an isolator chamber opening allowing access to the isolation chamber from a region exterior to the isolator unit, an isolator door frame coupled to the isolator shell and positioned to lie in the isolator chamber opening, the isolator door frame including an isolator seal support and an expandable isolator seal member, and an isolator door configured to mount to the isolator door frame and arranged to engage the isolator sea member and occlude an opening in the isolator door frame when in a closed position and to disengage the isolator seal member and allow access into the isolation chamber trough the opening in the isolator door frame when the isolator door is in an opened position, a mobile canister unit including a shell configured to define an interior canister chamber and formed to include a canister chamber opening allowing access to the canister chamber from a region exterior to the canister unit, a canister door frame coupled to the canister shell and positioned to lie in the canister chamber opening, the canister door frame including a canister seal support and a canister seal member, and a canister door arranged to engage the canister seal member and occlude an opening in the canister door frame when in a closed position and to disengage the canister seal member and allow access into the canister chamber through the opening in the canister door frame when the canister door is in an opened position, a seal expander configured to urge pressurized fluid moving through the isolator unit against the isolator seal member to move the isolator seal member to the expanded position forming a substantially airtight engagement between the isolator seal member and the isolator door and against the canister seal member to move the canister seal member to the expanded position forming a substantially airtight engagement between the canister seal member and the canister door.

45. An apparatus comprising an isolator unit including an isolator shell configured to define an interior isolation chamber and formed to include an isolator chamber opening allowing access to the isolation chamber from a region exterior to the isolator unit, an isolator door frame coupled to the isolator shell and positioned to lie in the isolator chamber opening, the isolator door frame including an isolator seal support and an expandable isolator seal member, and an isolator door configured to mount to the isolator door frame and arranged to engage the isolator seal member and occlude an opening in the isolator door frame when in a closed position and to disengage the isolator seal member and allow access into the isolation chamber through the opening in the isolator door frame when the isolator door is an opened position, a mobile canister unit including a shell configured to define an interior canister chamber and formed to include a canister chamber opening allowing access to the canister chamber from a region exterior to the canister unit, a canister door frame coupled to the canister shell and positioned to lie in the canister chamber opening, the canister door frame including a canister seal support and an expandable canister seal member, and a canister door arranged to engage the canister seal member and occlude an opening in the canister door frame when in a closed position and to disengage the canister seal member and allow access into the canister chamber through the opening in the canister door frame when the canister door is in an opened position, the mobile canister unit placed adjacent to the isolator unit and configured with the canister door frame removably connected to the isolator door frame and the opening in the canister door frame arranged to communicate with the opening in the isolator door frame when both the canister door and isolator door are in the opened position, and a seal member pressure control system including a pressurized air supply in fluid connection with a slave valve supply conduit and a pressure supply conduit and configured to allow flow of pressurized air into both the slave valve supply conduit and the pressure supply conduit, a master valve in fluid connection with the slave valve supply conduit and configured to move between a first position halting flow of pressurized fluid through the slave valve supply conduit and a second position allowing flow of pressurized fluid to continue through the slave valve supply conduit, a pressure selector valve in fluid connection with the pressure supply conduit and also in fluid connection with a vacuum generator, the pressure selector valve configured to move between a first position allowing the vacuum generator to remove air from the pressure supply conduit and a second position allowing the pressurized air supply to urge pressurized air into the pressure supply conduit, an isolator slave valve having a first input in fluid connection with the slave valve supply conduit and a second input in fluid connection with the pressure supply conduit and an output in fluid connection with the isolator seal member and configured to move from a first position wherein the movement of air through the pressure supply conduit to or from the isolator seal member is prohibited and a second position wherein movement of air through the pressure supply conduit to or from the isolator seal member is allowed and further configured to be biased in the first position and moved to the second position upon the receipt of pressurized air from the slave valve supply conduit, and an electronic controller electronically connected to the master valve and pressure selector valve and configured to command the master valve and pressure selector valve to increase or decrease the pressure on the isolator seal member, wherein the command to increase pressure on the isolator seal member is accomplished by communicating a signal from the electronic controller to the master valve causing the master valve to move to its second position allowing pressurized air to flow from the pressurized air supply to the first input of the isolator slave valve causing the isolator slave valve to move to its second position and by communicating a signal from the electronic controller to the pressure selector valve causing the pressure selector valve to move to its second position allowing pressurized air to flow through the pressure supply conduit through the second input of the isolator slave valve and through the output of the isolator slave valve to move the isolator seal member to its expanded position, and wherein the command to decrease pressure on the isolator seal member is accomplished by communicating a signal from the electronic controller to the master valve causing the master valve to move to its second position allowing pressurized air to flow from the pressurized air supply to the first input of the isolator slave valve causing the isolator slave valve to move to its second position and by configuring the pressure selector valve to its first position allowing the vacuum generator to remove pressurized air from the pressure supply conduit through the second input of the isolator slave valve and through the output of the isolator slave valve to move the isolator seal member to its contracted position.

46. The apparatus of claim 45 further comprising a first fluid junction in fluid communication with the slave valve supply conduit and in fluid communication with a canister slave valve supply conduit and configured to allow air to flow from the slave valve supply conduit through a portion of the isolator door frame and through a portion of the canister door frame and into or out of the canister slave valve supply conduit, a second fluid junction in fluid communication with the pressure supply conduit and in fluid communication with a canister pressure supply conduit and configured to allow air to flow to or from the flow the pressure supply conduit through a portion of the isolator door frame and through a portion of the canister door frame and to or from the canister pressure supply conduit, and a canister slave valve having a first input in fluid connection with the canister slave valve supply conduit and a second input in fluid connection with the canister pressure supply conduit and an output in fluid connection with the canister seal member and configured to move from a first position wherein the movement of air through the canister pressure supply conduit to or from the canister seal member is prohibited and a second position wherein movement of air through the canister pressure supply conduit to or from tho canister seal member is allowed and further configured to be biased in the first position and moved to the second position upon the receipt of pressurized air from canister slave valve supply conduit.

47. A method of opening a transfer conduit in a transfer port apparatus to enable a user to move an object between a canister chamber formed in a canister and an isolation chamber formed in an isolator through the transfer conduit without exposing the transfer conduit and the canister ad isolation chamber to the atmosphere, the method comprising the steps of providing a canister door frame arranged to surround an opening into the canister chamber, the canister door frame defining a portion of the transfer conduit and including a seal support and an inflatable seal coupled to the seal support, providing an isolator door frame arranged to surround an opening into the isolation chamber, first moving an isolator door from a central opening formed in the isolator door frame without passing the isolator door through a central opening formed in the canister door frame, second moving a canister door from the central opening formed in the canister door fame through the central opening formed in the isolator door after deflating an inflated seal included in the canister door frame and arranged to establish an airtight scaling engagement between the canister door fame and the canister door.

48. The method of claim 47, wherein the first moving step includes the steps of deflating an inflated seal included in the isolator door frame and arranged to establish an airtight sealing engagement between the isolator door frame and the isolator door and then dislodging the isolator door from a mounted position in the central opening of the isolator door frame.

49. A method of closing a transfer conduit in a transfer port apparatus to block fluid communication between a canister chamber formed in a canister and an isolation chamber formed in an isolator through a transfer conduit, the method comprising the steps of providing a canister door frame arranged to surround an opening into the canister chamber, the canister door frame defining a portion of the transfer conduit and including a seal support and an inflatable seal coupled to the seal support, providing an isolator door frame arranged to surround an opening into the isolation chamber, first moving a canister door through a central opening formed in the isolator door frame into a central opening formed in the canister door frame, inflating the inflatable seal to establish an airtight scaling engagement between the canister door frame and the canister door, and second moving an isolator door into the central opening formed in the isolator door frame.

50. The method of claim 49, wherein the second moving step includes the steps of inserting the isolator door into the central opening formed in the isolator door frame and inflating an inflatable seal included in the isolator door frame to establish an airtight sealing engagement between the isolator door and the isolator door frame.

* * * * *